US008887862B2

(12) United States Patent
Hughes, II

(10) Patent No.: US 8,887,862 B2
(45) Date of Patent: Nov. 18, 2014

(54) PHASE PLUG DEVICE

(71) Applicant: Charles Emory Hughes, II, Gastonia, NC (US)

(72) Inventor: Charles Emory Hughes, II, Gastonia, NC (US)

(73) Assignee: Bag End, Inc., Lake Barrington, IL (US)

( * ) Notice: Subject to any disclaimer, the term of this patent is extended or adjusted under 35 U.S.C. 154(b) by 0 days.

(21) Appl. No.: 14/187,971

(22) Filed: Feb. 24, 2014

(65) Prior Publication Data

US 2014/0262600 A1 Sep. 18, 2014

Related U.S. Application Data

(60) Provisional application No. 61/798,557, filed on Mar. 15, 2013.

(51) Int. Cl.

| | |
|---|---|
| ***G10K 11/02*** | (2006.01) |
| ***G10K 11/04*** | (2006.01) |
| ***H04R 1/22*** | (2006.01) |
| ***H04R 1/30*** | (2006.01) |
| ***H04R 1/00*** | (2006.01) |
| *G10K 11/00* | (2006.01) |
| *G10K 11/18* | (2006.01) |
| *H04R 1/20* | (2006.01) |

(52) U.S. Cl.

CPC ..... *H04R 1/00* (2013.01)
USPC ..... 181/175; 381/337; 381/343

(58) Field of Classification Search

CPC ..... G10K 11/00; G10K 11/02; G10K 11/025; G10K 11/04; G10K 11/18; H04R 1/20; H04R 1/22; H04R 1/227; H04R 1/30
USPC ..... 181/156, 175, 185, 177; 381/337, 338, 381/343, 349, 161, 339, 340
See application file for complete search history.

(56) References Cited

U.S. PATENT DOCUMENTS

| | | | | | |
|---|---|---|---|---|---|
| 4,091,891 | A * | 5/1978 | Hino et al. | ..... | 181/185 |
| 4,390,078 | A * | 6/1983 | Howze et al. | ..... | 181/185 |
| 4,718,517 | A * | 1/1988 | Carlson | ..... | 181/159 |
| 4,776,428 | A * | 10/1988 | Belisle | ..... | 181/185 |
| 5,163,167 | A * | 11/1992 | Heil | ..... | 181/152 |
| 6,026,928 | A * | 2/2000 | Maharaj | ..... | 181/152 |
| 6,094,495 | A * | 7/2000 | Rocha | ..... | 381/340 |
| 6,095,279 | A * | 8/2000 | Adamson | ..... | 181/152 |
| 6,343,133 | B1 * | 1/2002 | Adamson | ..... | 381/340 |
| 6,581,719 | B2 * | 6/2003 | Adamson | ..... | 181/182 |
| 6,628,796 | B2 * | 9/2003 | Adamson | ..... | 381/342 |
| 6,650,760 | B1 * | 11/2003 | Andrews et al. | ..... | 381/343 |
| 6,668,969 | B2 * | 12/2003 | Meyer et al. | ..... | 181/177 |
| 7,177,437 | B1 * | 2/2007 | Adams | ..... | 381/340 |
| 7,510,049 | B2 * | 3/2009 | Kling | ..... | 181/187 |
| 7,631,724 | B2 * | 12/2009 | Onishi | ..... | 181/192 |
| 7,735,599 | B2 * | 6/2010 | Kubota | ..... | 181/192 |
| 2002/0014368 | A1 * | 2/2002 | Adamson | ..... | 181/182 |

* cited by examiner

*Primary Examiner* — Edgardo San Martin
(74) *Attorney, Agent, or Firm* — Vangelis Economou; Economou IP Law

(57) ABSTRACT

An acoustical phase plug for use in loudspeakers produces a planar rectangular wavefront, or a wavefront with a desired amount of curvature, from the output aperture of the phase plug device when presented with a planar circular wavefront at the input aperture. The phase plug utilizes a waveguide that equalizes the travel paths from the input aperture to the output aperture. The waveguide essentially eliminates surface discontinuities thereby resulting in the reduction of diffraction of the wavefront travelling through the phase plug device.

12 Claims, 12 Drawing Sheets

PHASE PLUG DEVICE

CROSS REFERENCE TO RELATED APPLICATIONS

This is a non-provisional of U.S. patent application Ser. No. 61/798,557, filed Mar. 15, 2013, and, the entire specification of which is incorporated by reference herein as if fully set forth.

BACKGROUND OF THE INVENTION

1. Field of the Invention

The present invention relates generally to phase plugs for loudspeakers and more particularly to acoustical phase plugs that can provide either a rectangular planar wavefront or a rectangular wavefront with a desired radius of curvature from an output aperture of the phase plug.

2. Background Art

Acoustic design in general, and loudspeaker design in particular, benefits in sound quality from transformation of the shape of the wavefront radiated from a given device, such as a transducer, or driver, from a spherical wavefront to a planar wavefront. When far enough away, a planar driver aperture can be almost considered to be a point source and the wave is experienced as a spherical wave. As result of the sound projection from a finite planar source, some diffraction occurs as a result of the size of the sound source. Different shapes or different boundary conditions that tend to confine the wavefront have been proposed in various ways in an effort to equalize the path lengths and provide for a planar rectangular wavefront at the exit aperture.

One such attempt was the use of a frusto-conical diaphragm design for a phase plug in U.S. Pat. No. 4,718,517 to Carlson, assertedly so as to provide a direct acoustic coupling of the cone type or apex driven loudspeaker to the entry of a rectangular horn. Similarly, Heil in U.S. Pat. No. 5,163,167 and Adamson in U.S. Pat. No. 6,095,279, each utilize a spreading cone having as a central element within a similar, cone-shaped cavity to transform a circular planar wavefront emitted by a compression driver into a rectangular planar wavefront. Both these patents include a section that begins as a cone, but transitions to a wedge shaped end created by surfaces that obliquely section through the conical surface, that is, with the cutting planes intersecting the diameter of the circular base for Heil or the major axis of the ellipse for Adamson.

Adamson in U.S. Pat. No. 6,581,719 teaches that for any horn type device to be considered a true waveguide, it must meet the criteria that the wavefront will always intersect the boundary of the waveguide at a 90 degree angle. Adamson also suggests in the patent that any boundary not normal to the wavefront will cause a reflection of energy, thus reducing contact with the waveguide wall. The ramification of this is that for opposing walls that diverge, the wavefront propagating through the horn must have some amount of curvature. Adamson '719 attempts to solve this problem of a curved wavefront by adding a second "wave shaping" chamber to a primary waveguide structure (in the shape of a simple horn). The simple horn acts to expand the sound wave to a circular or arcuate ribbon shape having a rectangular exit profile. In the separate second chamber, the arcuate sound wavefront is directed around an oblong shaped obstruction to provide a desired change, e.g. greater uniformity, in the different path lengths.

In another attempt to provide a uniformly rectangular planar wavefront at especially higher frequencies, as described by Heil in U.S. Pat. No. 5,163,167, a waveguide is placed at the output end of a compression driver to provide a transformative function and thereby to expand the wave from a circular planar surface, that is, a wavefront that is planar in cross-section with circular boundary constraints, to a rectangular planar wave surface, that is, a wavefront that is planar in cross-section with rectangular boundary constraints. Heil teaches a loudspeaker device having a compression chamber, with the device having a conduit with plural passages and two openings at the ends of the passages. One end is fitted to the output orifice of a compression driver, and the other end is the output orifice of the loudspeaker device. A planar, or isophase, circular wavefront is thus transformed at the other end, comprising the loudspeaker device output, so it emits a planar and oblong, and ideally, a planar rectangular isophase wavefront. Heil further describes the phase plug in the conduit as desirably providing passages for the propagation of sound energy such that the time interval between the input and output orifices remains at the shortest paths allowed within the passages are of practically equal length from the input orifice to the output orifice of the conduit. The device is said to improve at higher frequencies, particularly for frequencies with wave lengths less than approximately 15 cm.

Adamson teaches the use of a loudspeaker and chamber with a waveguide structure in several patents, including U.S. Pat. Nos. 6,095,279, 6,343,133, 6,581,719 and 6,628,796, and teaches devices that utilize an inner body as a central element within a similar shaped cavity to transform a circular planar wavefront radiated by a compression driver into a rectangular planar wavefront at the output of the device into a horn section. As described above, in U.S. Pat. No. 6,581,719, Adamson teaches use of two separate chambers, a primary waveguide which generates a rectangular cylindrical wavefront, and a separate second sound wave forming chamber that provides purposefully designed unequal pathlengths so as to transform the rectangular cylindrical wavefront to a rectangular planar wavefront. Adamson teaches that a rectangular planar wavefront is better suited to drive the input of certain horn designs, as well as for use in line array applications.

The surface in the devices disclosed by Adamson '279 differs from that of Heil in that the frusto-conical insert is not circular at its base, but is instead elliptical with the cutting planes intersecting the semi-major axis, instead of the diameter of a circular base. This allows for a path length along the middle of the surface to be slightly shorter than a path length along the top or bottom of the surface.

However, the Heil and Adamson '279 configurations both include discontinuities in the wave guide path that introduce a certain amount of diffraction and interference with the wavefront. These discontinuities generate unwanted diffraction, which affects the optimum quality of the sound as it is emitted from the output orifice and is projected into a horn or into free space. The parabola shaped transitional edge between the conical portion and the wedge portions of both Heil and Adamson give rise to diffraction of the sound wavefront caused by the discontinuities within the cavity formed by the inner body and outer shell. This leads to less than optimum performance of the device because of the resulting interference in the wavefront caused by the reflected sound within the cavity originating from the diffraction at the discontinuities. Diffraction of the sound wavefront is to be avoided to eliminate the possibility of detrimental interference. As described, Adamson '719 requires two separate chambers to transform a rectangular cylindrical wavefront to a rectangular planar wavefront, thereby increasing the overall length of the device and the pathlength which the sound waves must travel.

Other attempts have been made toward the same end, for example, in U.S. Pat. No. 6,650,760 to Andrews et al., U.S. Pat. No. 6,668,969 to Meyer, U.S. Pat. No. 7,177,437 to Adams, U.S. Pat. No. 7,510,049 to Kling, U.S. Pat. No. 7,631,724 to Onishi and U.S. Pat. No. 7,735,599 to Kubota. However, the above described attempts all suffer from similar problems as do the '279 Adamson and Heil devices, albeit some to a lesser extent.

The prior art patents to date teach configurations having some amount of discontinuities in the waveguide, or require at least two chambers to accomplish the transformation, thereby necessarily lengthening the dimension of the phase plug device. Thus, what is desired is a method for determining and transforming a uniform wavefront at an input aperture, guided through one or more passages, to produce a wavefront with a predetermined amount of curvature (or no curvature), as desired, at an output aperture. Ideally, the wavefront emitted from this configuration has little or no change to the spectral content of the wavefront at the output aperture compared to the input aperture. That is, it is desirable for constructive and destructive interference at various frequencies to be avoided. Also desirable is a true waveguide derived from the use of a single chamber device that transforms a circular planar wavefront to a rectangular planar wavefront, and provides continuity in the waveguide, avoiding any discontinuities or sharp angles. This ideally produces an isophase rectangular planar wavefront, or a wavefront with a desired amount of either convex or concave curvature, as it exits the output aperture of the phase plug device, and enters either a loudspeaker horn or the open acoustic space beyond the output aperture.

SUMMARY OF THE INVENTION

In one aspect, the present invention is intended for use primarily, but not exclusively, together with compression drivers, either singular or plural. The inventive insert for the phase plug utilizes a portion of a cone as a first portion, having an apex at one end intended to be disposed at the input aperture of the phase plug device, and a third portion comprising a modified wedge-shaped portion at the opposed end and intended to be disposed adjacent the output aperture. These two portions are joined by a second transitional central portion having an ovoid like surface that is reminiscent of an essentially divergent pear shape for which each arc length taken in the direction from the input aperture to the output aperture follows an elliptical path. The two end portions, both the conical first portion and the modified wedge-shaped portion, must be tangent to the elliptical arc length at the point at which each portion mates with the surface of the second transitional central portion. The parameters that define the shape of an elliptical arc length joining the two end portions for a given path in the plane in which the path between the ellipse and two portions occurs is dependent on the angle $\phi$, taken with respect to the horizontal center-line of the inventive insert. As the path lengths are close to being equal at several consecutive angles $\phi$, an approximating function is used to join the paths in a smooth curve to provide the desired surface curvature of the insert, as well as the corresponding outer surface of the chamber in which the insert is disposed, so as to follow the surface of the insert at a predetermined separation, to form the smooth waveguide in which discontinuities are avoided. Thus, the wavefront transmitted through the waveguide remains uniform and encounters no discontinuities.

The complete surface formed by the conical first portion, the third modified wedge-shaped portion, and the surface of the second transitional portion defined by elliptic arc lengths joining the first and third portions, provide the outer surface of the inner insert of one embodiment of the invention. The chamber through which sound waves travel is formed by offsetting the surface of the insert a specified distance away from the insert surface of the insert. This new surface defines the inner surface of the outer shell. It is the cavity between the inner insert and the outer shell that together form the conduit of the waveguide through which the sound waves travel in a uniform and desirable manner.

In one embodiment in which the inventive phase plug is intended for use with a single driver, the phase plug provides continuity to the wavefront as it exits the output aperture which is rectangular and much greater in the longitudinal direction that in the transverse direction. For uses wherein plural drivers and plural phase plugs are used, the shape of the wavefront that is emitted from the output aperture of the phase plug provides much more continuous coupling with its neighbors, particularly in the higher frequency regions where the wavelength of the emitted sound waves approach small dimensions.

It should be noted that, both in the prior art and for the present invention, a planar wavefront is primarily referring to the curvature (or lack thereof) in the vertical plane. Thus the wavefront at the output aperture of both the prior art and the present invention is not fully planar, but only planar when taken along the vertical dimension. There may be some curvature of the wavefront in the horizontal plane. However, this is immaterial to the both the prior art and the present invention.

In accordance with the invention described and claimed herein there is disclosed a sound energy waveguide, comprising a chamber having a substantially circular input aperture at one end of said chamber and an elongated, thin output aperture at an opposed end of said chamber, said chamber comprising an outer wall having an inner surface, an integral insert disposed within the chamber having a continuous, smooth, outer surface and a positioning mount for disposing the insert within the inner surface of the outer wall of the chamber the insert further having a first conical portion located adjacent the input aperture when inserted within the chamber, a third wedge shaped portion having an elongated end proximate the elongated output aperture, and an ovoid central section disposed between the first and second portions, wherein the outer surface of the three portions are without discontinuities and blend one into the other to provide a smooth outer surface of the insert the inner surface of the chamber outer wall and the insert outer surface are equidistantly disposed from each other throughout the chamber as the measurements are taken normal to the surfaces, so that the two wall surfaces define an acoustic conduit between the inner surface of the outer wall and the outer surface of the insert extending from the input aperture to the output aperture, said conduit thereby forms a waveguide that provides essentially constant, or desired variant, path lengths extending from said input aperture to said output aperture, the waveguide allows for the propagation of sound waves from the driver along said substantially constant or desired variant path lengths from said input aperture to said output aperture.

BRIEF DESCRIPTION OF THE DRAWINGS

The present invention will be discussed in further detail below with reference to the accompanying figures in which.

DETAILED DESCRIPTION OF THE PREFERRED EMBODIMENTS

The present invention is directed to phase plugs for loudspeakers and other sound radiating devices which provide an isophasic wavefront from the output aperture of the phase plug by synchronization of the sound waves at substantially all frequencies at the output aperture. Ideally, the inventive phase plug can be utilized for a variety of intended uses and is endowed to provide the benefits of the invention whether the wavefront originates from a single sound source or from plural sources.

The usual sound source is a compression driver that emits sound waves in an essentially circular planar wavefront from its exit aperture. The inventive phase plug transforms the sound energy into an essentially planar rectangular wavefront where the rectangular output aperture has a width dimension in one direction that is significantly different than the dimension in the normal, longitudinal direction. The preferred manner of providing this function is to transform an essentially circular planar wavefront emanating from a compression driver, usually having a circular aperture, and through manipulation of the wavefront by forcing the waves through a waveguide, transposing the sound wavefront toward an aperture that is oblong, and preferably, rectangular. In one aspect for use of the inventive phase plug, an array of loudspeakers may be vertically stacked, each putting out a planar wavefront that is synchronized to provide a column of sound that is clear and coherent across the complete spectrum of audible sound frequencies. The phase plug preferably performs this function without either constructive or destructive interference due to secondary wavefronts or subsequently generated wavefronts created by diffraction. The interference caused by these secondary wavefronts can produce undesirable frequency response characteristics at the output aperture of the heretofore known phase plug devices. It is desirable that a single planar wavefront emanate from one or more output apertures of the inventive device and into a horn or other output device that generates the output sound to the space beyond the loudspeakers.

Figure 1:
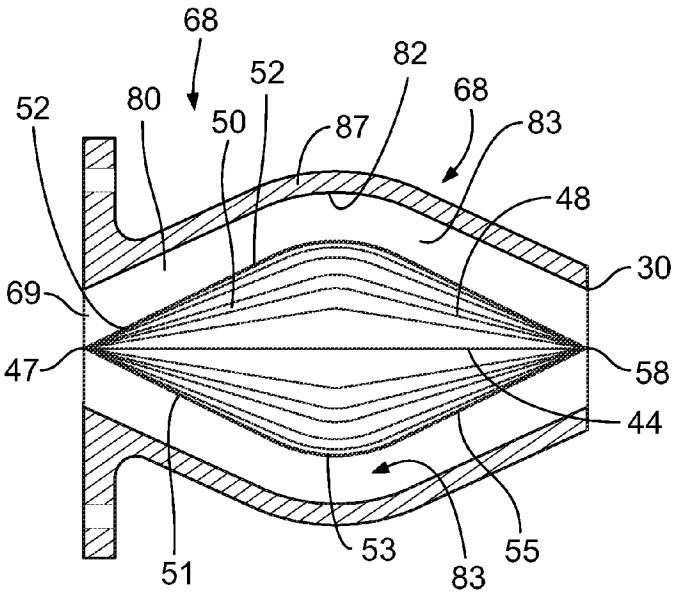
FIG. 1 is a partially cutaway view of a phase plug, including an insert shown in a top plan view and disposed within an internal chamber of the inventive phase plug.

Referring now to FIG. 1, a plan cutaway view of a phase plug 68 according to the present invention is shown, including an insert 50 within a chamber 80. The chamber 80 is defined by an internal chamber wall surface 82 of the outer shell 87, shown in cutaway cross-section, which together with the outer surface 52 of the insert 50, provides a conduit or passage 83 that is defined by a multitude of paths bounded by the surfaces 52, 82 traversing within the conduit 83 from the circular aperture 69, nearest the driver (62, FIG. 4) to the oblong, and essentially rectangular, output aperture 30. FIG. 1 accurately shows the insert 50 is as being symmetrical in a top, cutaway cross-sectional plan view, and as can be most clearly seen in FIG. 4B, the essentially circular shape of aperture 69 is transformed into the rectangular aperture 30.

As will be explained below, and especially with reference to FIG. 2, it is helpful to consider the insert 50 as comprising three portions—conical portion 51, transitional central portion 53 and wedge shaped portion 55. It should be kept in mind that there is an expansion, in the vertical direction (shown most clearly in FIGS. 3 and 5), of the wedge shaped portion 55 so that a planar rectangular wavefront can be emitted from the aperture 30. Thus, and referring now to FIG. 2, the shape of the insert 50 is transformed from the conical portion 51 through the central transitional portion 53 to a wedge shaped portion 55, converging to a linear edge 58 (best seen in FIG. 2), and explained in greater detail below with respect to the embodiment shown in FIG. 4.

Figure 2:
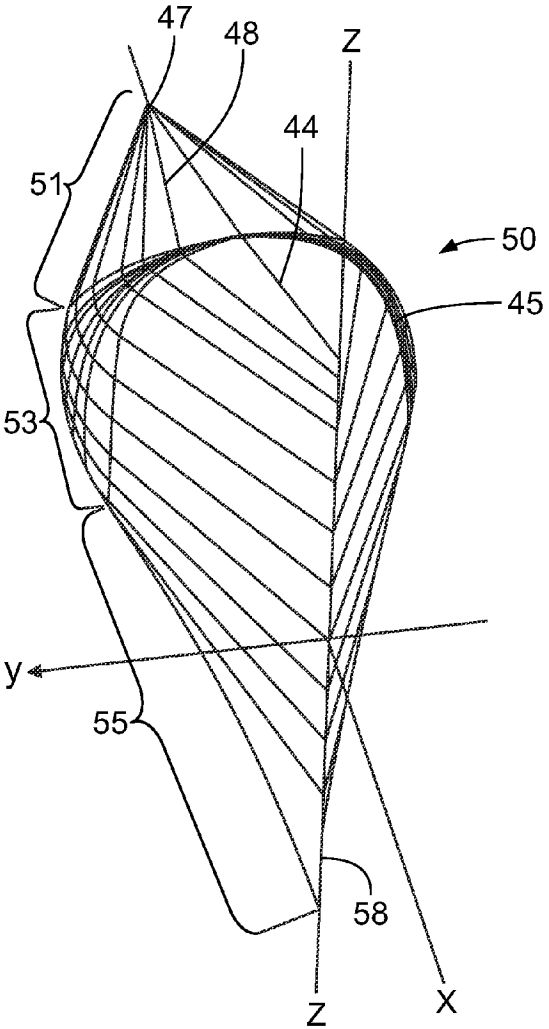
FIG. 2 is a frontal isometric view of a phase plug insert showing the contoured surface of the insert according to the present invention.
Figure 4:
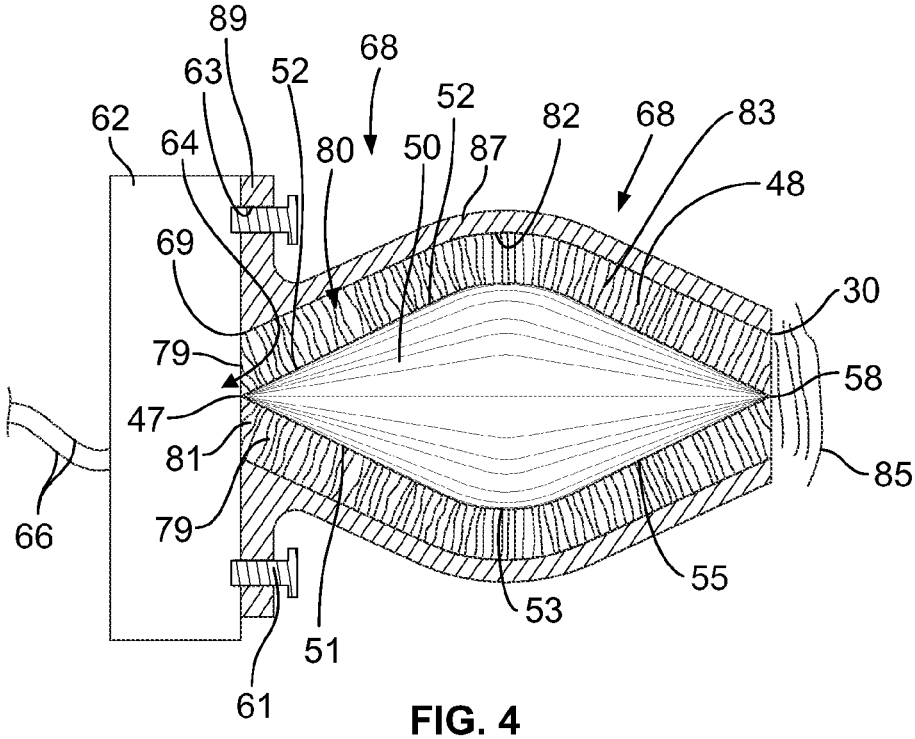
FIG. 4 illustrates in a cross-sectional top plan view of one embodiment of the phase plug according to the present invention, showing propagation of the sound waves through the waveguide between the insert and the internal chamber wall.

Referring now generally to FIGS. 1 and 2, FIG. 2 illustrates an isometric schematic view of the insert 50 in isolation without the internal chamber wall surface 82 of the outer shell 87 of chamber 80 of the phase plug 68 blocking the view. It is clear for operation that the inventive phase plug 68 requires both the chamber wall surface 82, as well as the outer surface 52 of insert 50 to operate as intended, but for purposes of clarity only the insert 50 is shown in FIG. 2. It should be understood that the insert 50 must be held in position by one or more structural supports. A more measured and clearer depiction of the shape of insert 50 is provided in FIG. 2, essentially identical to that shown disposed within chamber 80 (FIGS. 1 and 4). It is shown as comprising the three joined integral portions 51, 53, 55, each having a different function in respect of the waveguide conduit 83 disposed in chamber 80 provided by the phase plug 68.

Referring again to FIG. 1, the first conical portion 51 is disposed with an apex 47 immediately adjacent input aperture 69. The conical portion 51 of insert 50 essentially starts out as a cone from the apex 47, which is the first point of encounter of the sound waves with the insert 50. The apex 47 first receives the sound energy in the form of a circular planar wavefront from the compression driver 62 (shown in FIG. 4). As the sound energy travels through the conduit 83, the conical portion 51 is intended to essentially divide the circular planar wavefront emanating from the compression driver 62 (FIG. 4; not shown in FIG. 1 or 2) into an annular ring that propagates along the contour of the surface 52 of conical section 51 and surface 82 of the outer shell wall 87. It should be noted that the internal wall surface 82 of outer shell wall 87 follows a similar contour as the surface 52 to define the waveguide conduit 83 so as to guide the wavefront in the manner desired. Thus, the function of the conical section 51 is to maintain the characteristic planar wavefront emitted by the driver 62 (FIG. 4), in the form of an annular ring advancing through the waveguide conduit 83 that is uniform along all directions of the cone as it travels from the apex 47 through the conduit 83. As the wavefront continues through the conduit 83 it approaches and comes into contact with the second central ovoid portion 53.

As can be more clearly seen in FIG. 2, indeed in all the first four figures, between the conical portion 51 and the wedge-shaped portion 55, the transitional ovoid central portion 53 maintains the propagation of a planar wavefront while maintaining a continuous smooth surface until reaching the wedge-shaped portion 55. As the wavefront proceeds through the conduit 83, the surface 52 is transformed from the essentially conical shape of the first portion 51 into the more curved transitional shape of portion 53 that is partially conical at one end but transforms into a convergent wedge-shaped portion 55 toward the other end. The ovoid shaped transitional portion 53 provides the important function of equalizing all the paths F, extending from the input aperture 69 to the output aperture 30, as will be explained below.

It should be further understood that the surface 52 takes on an optimal shape while eliminating discontinuities encountered for any single acoustical path traversing over it. That is, the path follows a straight path over the conical portion 51, changes to the minimal elliptical path as it traverses the ovoid central portion 53 and again reverts to a straight line path as it completes its journey at the wedge-shaped portion 55 before it exits from the output aperture 30. This arrangement provides a most elegant method of essentially eliminating the discontinuities that occur in most heretofore known devices.

Figure 3:
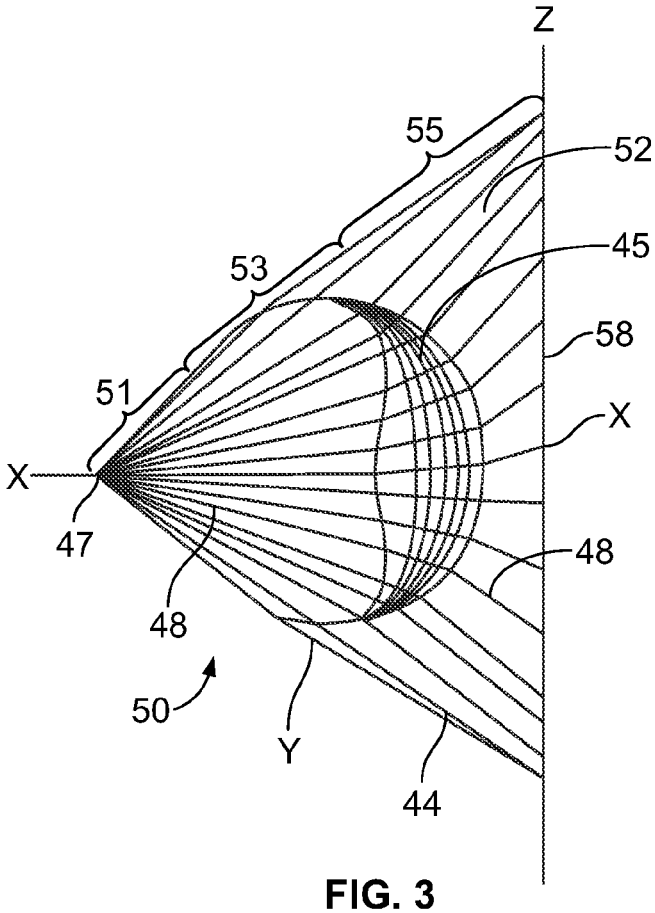
FIG. 3 is a rear isometric view of the same phase plug insert shown in FIG. 2.
Figure 18:
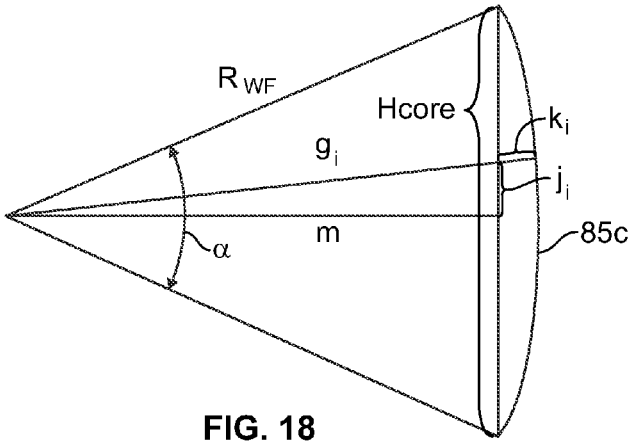
FIG. 18 is a schematic side view showing the desired curvature in the output wavefront produced by an alternative embodiment of the device.

The third, wedge-shaped, end portion 55 is most clearly shown in FIGS. 2 and 3. As the insert surface 52 reaches the wedge shaped portion 55 it diverges longitudinally from the x-y plane. The isometric view of FIG. 3 provides a 2-D representation of the shape of the insert, or rather at least the right side that is visible in FIG. 3. As can be seen in FIGS. 2 and 3, however, the top and bottom halves, that is, the two parts of the insert 50 on either side of the horizontal x-y plane, are mirror images of each other. Similarly, the right and left sides, that is, the two parts of the insert 50 on either side of the vertical x-z plane, are mirror images of each other. The arcs 45 are representative of the longitudinal curvature of the ovoid transitional portion 53. The essentially "straight" lines 48 radiating from the apex point 47 toward the edge 58 represent path lines of sound energy that would traverse along the surfaces 52, 82 (through the conduit 83; see FIG. 1) as the sound energy is transmitted from the initial contact at the apex 47 toward the edge 58, and from the input aperture 69 to the output aperture 30 (FIGS. 1 and 4). As can be seen from FIG. 2, the sharp edge 58 is the result of the convergence of the surfaces 52 on opposite sides of the wedge-shaped portion 55. This provides a seamless transition for the recombination of wavefronts 79 at opposite sides of the wedge shaped portion 55 into a single wavefront 85 (FIG. 4). It should be understood that the device 68 can be designed so that wavefront 85 can be either a planar rectangular wavefront or a convex or concave rectangular wavefront, as desired, depending on the resulting use. Typically this no curvature, or the desired curvature of the wavefront as discussed below in reference to FIG. 18, is achieved in the longitudinal dimension.

Referring generally now to FIG. 4, the propagation of the wavefront of sound energy can be considered to be emitted from the driver 62 as a planar circular wavefront, schematically represented by the wavy line 81, emitted by driver 62 and entering the chamber 80 essentially normal to the x-axis, represented in FIG. 4 by the centerline CL, or with a some amount of divergence from the x-axis due to a minor amount of wavefront curvature at the exit of the compression driver. As the wavefront 81 comes into contact with insert 50, the conical apex 47 divides the circular planar wavefront into an annular ring planar isophase wavefront 79 which traverses along the waveguide conduit 83 as a separated, but synchronized wavefront. As the wavefront 79 reaches the transitional ovoid second portion 53, the waveguide conduit 83 begins to bulge out toward the horizontal sides (the y direction in FIG. 2) as it follows surface 52 and becomes more ovoid and diverges in the vertical direction z at the horizontal center of the insert 50 (essentially immediately along the x axis in FIG. 2). The wavefront is still contiguous throughout the conduit 83, but with the exception of a possible common connection point between the insert 50 and the internal wall surface 82 of outer shell 87, provided by fins 54 extending from the longitudinal edges 44 of insert 50 (FIGS. 4A and 4B) to the surface 82 of outer shell wall 87. The annular wavefront 79, 83 is essentially separated into two mirror imager halves (FIG. 4), one traversing the left side and one traversing the right side of the phase plug with respect to the edge 58 disposed adjacent the output aperture 30.

The separated planar wavefront is guided by the transitional portion 53 to maintain equal path lengths traveled by the sound energy throughout the entire device. These two wavefronts, that is the planar wavefronts that are directed essentially left and right, respectively, of the wedge-shaped portion 55, converge as they clear the edge 58 once again to form a single wavefront 85 at the output aperture 30. However, whereas at the conical apex 47 the wavefront is a circular planar wavefront 81 and is separated into an annulus, as the wavefront 85 is emitted from the output aperture 30, it is a rectangular planar wavefront extending along the oblong aperture 30 normal to the x-axis (centerline CL in FIG. 4). Most significantly, and as can be seen from all of the illustrations in FIGS. 1-4, the surface 52 defined by all the paths through the conduit 83 (FIGS. 2 and 3) are smooth and continuous. That is, none of the paths have discontinuities that would lead to diffraction which would subsequently interfere with the propagation of the original wavefront of sound wave energy through the waveguide conduit 83.

This is shown in FIGS. 2 and 3 and described in detail below. The contour of the transitional portion 53 is an important feature of the invention, in that its function is to provide for a smooth transitional portion 53 between the conical portion 51 disposed at the input end 69 and the wedge portion 55 disposed at the output end adjacent aperture 30. That is, the wavefronts, shown as successive wavy lines 79 (FIG. 4), are synchronized as they traverse through the conduit 83, so that when a wavefront 79 reaches the end of the wedge portion 55 and clears the edge 58, the conjoining of the two halves of the wavefront at the edge 58 are synchronized and coherent resulting in a planar wavefront 85 in the longitudinal dimension. Furthermore, the lack of any discontinuities within the interior conduit 83 eliminates the possibility of diffraction, and therefore the possibility for secondarily generated wavefronts to interfere with the original, primary wavefront.

The central ovoid portion 53 provides the crucial function to the inventive insert 50, which is to ensure that all of the paths from the input aperture 69 to the output aperture 30 retain the isophase relation of the wavefront as it is being guided through the conduit 83 through the separate areas of the chamber 80 in the different paths along the surface 52. Moreover, because of the elimination of any discontinuities by the inventive insert 50, interference resulting from diffraction of sound waves is avoided and the sound exiting from output aperture 30 maintains the same spectral content as the sound entering the input aperture 69. Thus, as will be explained more clearly below, the central ovoid portion 53 will provide a means by which all of the paths, as measured from the input aperture 69 to the output aperture 30, will be equalized in a smooth continuous manner.

Referring again to the phase plug insert 50 shown schematically in FIG. 2, the transitional portion 53 having a three dimensional, almost pear, shape transforms to the third wedge-shaped portion 55 which includes path segments that are linear and converge to a linear edge 58 at the proximal end adjacent the output aperture 30 (FIG. 4), as shown. When installed in the phase plug device 68, the edge 58 is disposed proximate to the output aperture 30, and extends in a line parallel to the longitudinal direction of the oblong output aperture 30 of the chamber 80. The edge 58 may be immediately adjacent to the output aperture 30. The edge 58 may protrude past the output aperture 30 or it may reside inside the chamber 80. The reason that a sharp linear edge 58 is desirable at the output aperture 30 is for the sound wavefront coming through the conduit 83 (FIG. 1) transmitted to either side of the edge 58 (at the output end), provides that the two streams of the wavefront from both the left and right combine properly into a single planar wavefront. The general shape of the third portion 55 is that of a flat sided wedge, and is variously referred to herein only for the sake of brevity as the "wedge" or "wedge-shaped" portion 55.

As seen in FIGS. 1-4, the wedge shaped portion 55 smoothly flows from the central transitional portion 53 in a manner that is free of discontinuities. As described below, there is a mathematically defined point that would be optimal for the transition from the conical portion 51 to the ovoid (elliptical) portion 53 and from the ovoid (elliptical) portion 53 to the wedge shaped portion 55 which would also provide for no discontinuities within the conduit 83 of the phase plug 68. This results from all given paths on the surface 52, either going into or exiting out of the central transitional ovoid portion 53, being at a tangent to the ellipse along that path. In other words, both the tangents t, t' and the ellipse define the surface 52 of the insert 50. It should be understood that in defining the portions 51, 53, 55, the tangent lines t, t' are straight and define the surfaces of the two end portions 51, 55. Similarly the ellipse represents a path along the surface 52 of the central ovoid portion 53.

Figure 6:
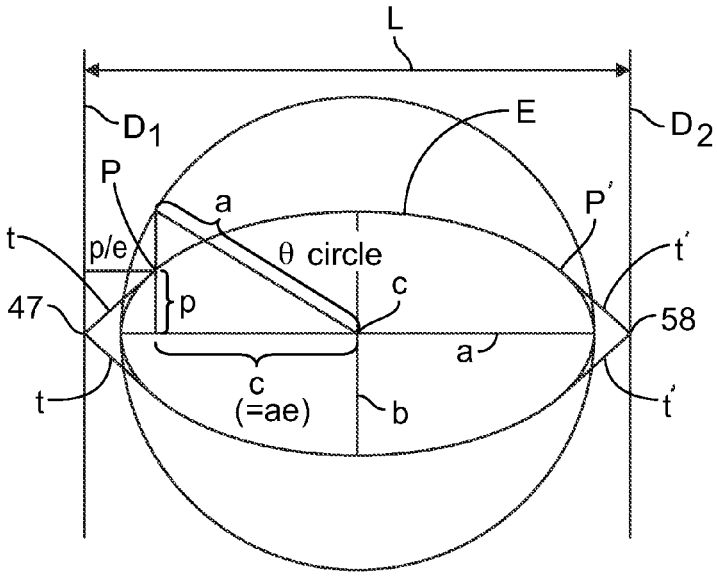
FIG. 6 is a schematic top plan view of the phase plug insert showing dimensions and layout of the elements used in calculations of the shape and dimensions of the phase plug insert.

This is illustrated by the line segments labeled t, t' that extend from a point of intersection with either side of the ovoid central portion 53 as shown in FIG. 6. That is, since the end points of the pair of the tangent segments t, and the pair of the tangent segments t', must each intersect at the directrices $D_1$, $D_2$, respectively, these tangent line segments best provide the paths that will intersect the ovoid shape at points p and p', respectively, to produce the equal path lengths necessary for the planar wavefront, or other desired curvature (see FIG. 18), at the exit aperture 30. As will be appreciated when a comparison is made between FIGS. 1-4 and the schematic diagram of FIG. 6, the intersection of the tangent lines t represents the natural apex 47 of the conical portion 51. At the opposite end with the wedge shaped portion 55, tangent lines t' will define the convergent surfaces of the wedge-shaped portion 55. Ideally, with elliptical path lengths of the central ovoid portion 53, the tangents t and t' are the same for a given cross-sectional angle $\phi$ that is taken through the insert 50, one each of which are shown in the views of FIGS. 7A-B through 11A-B.

It should be noted that the internal wall surface 82 of the chamber 80 follows a similar contour as the outer surface 52 of the phase plug insert 50 so as to define the width W (FIG. 5) of waveguide conduit 83. Ideally, the contour is as exact a match as possible, given the separation between them, but the goal is to maintain an equidistant relationship at all local positions taken at a straight line dimension from the surface 52 to the surface 82 and normal to each. By definition, the conduit 83 will represent a true waveguide, since the smooth calibrated contours of the surfaces 52, 82 will have no sharp corners or discontinuities, and thus avoid sound wave diffraction. The sound wavefronts 79 (FIG. 4) can be considered to be planar wavefronts extending normal to their direction of propagation between the outer surface 52 of the insert 50 and the inner wall 82 of the chamber 80. The most essential feature of the invention is to provide for a conduit 83 that propagates a planar wavefront that extends between the outer conical surface 52 of the conical portion 51 and inner surface of wall 82 in a conical section of the surface 52 around the insert 50 with no discontinuities.

Figure 4A:
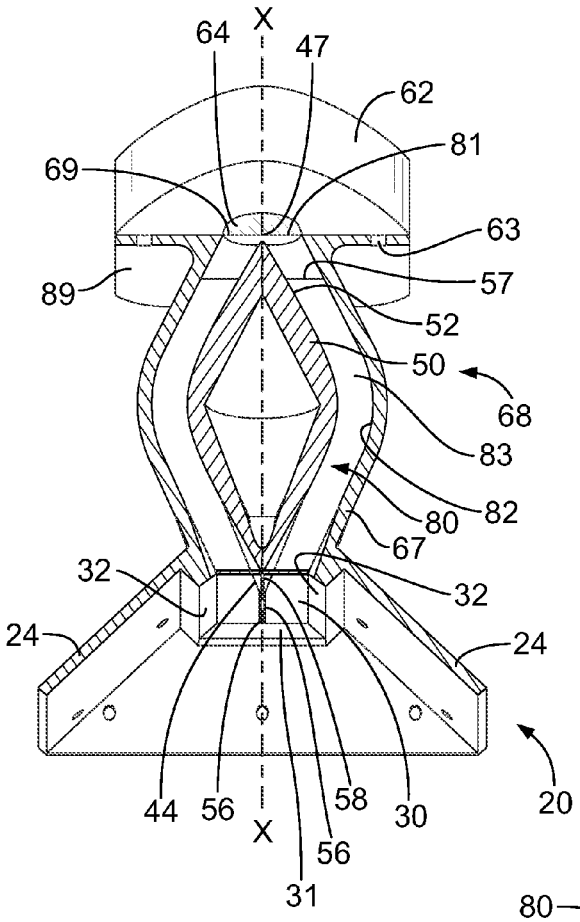
FIG. 4A illustrates in a perspective cross-sectional plan view of one embodiment of the phase plug according to the present invention shown in FIGS. 1 and 4, showing the insert and internal chamber walls and including the supports for the insert of the phase plug.

As shown in FIGS. 4 and 4A, the phase plug device 68 is connected to driver 62 at a flanged extension 89 of the outer shell wall 87 by means of screws 61 extending through holes 63 in the flanged extensions 89, or by other appropriate means, so that the surfaces of the flanged extension 89 and of the driver are essentially flush. Ideally, the aperture 69, shown as a circular aperture (FIGS. 4A, 4B) is of the appropriate size to overlay the output aperture 64 of the driver 62.

Figure 4B:
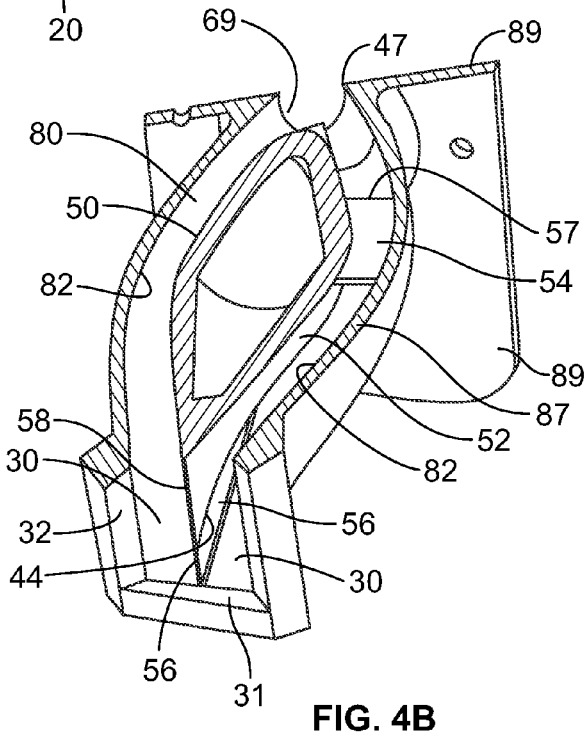
FIG. 4B illustrates in a perspective cross-sectional view of one embodiment of the phase plug according to the present invention shown in FIGS. 1 and 4, showing the insert in cutaway and internal chamber walls and the supports for the insert of the phase plug.
Figure 12:
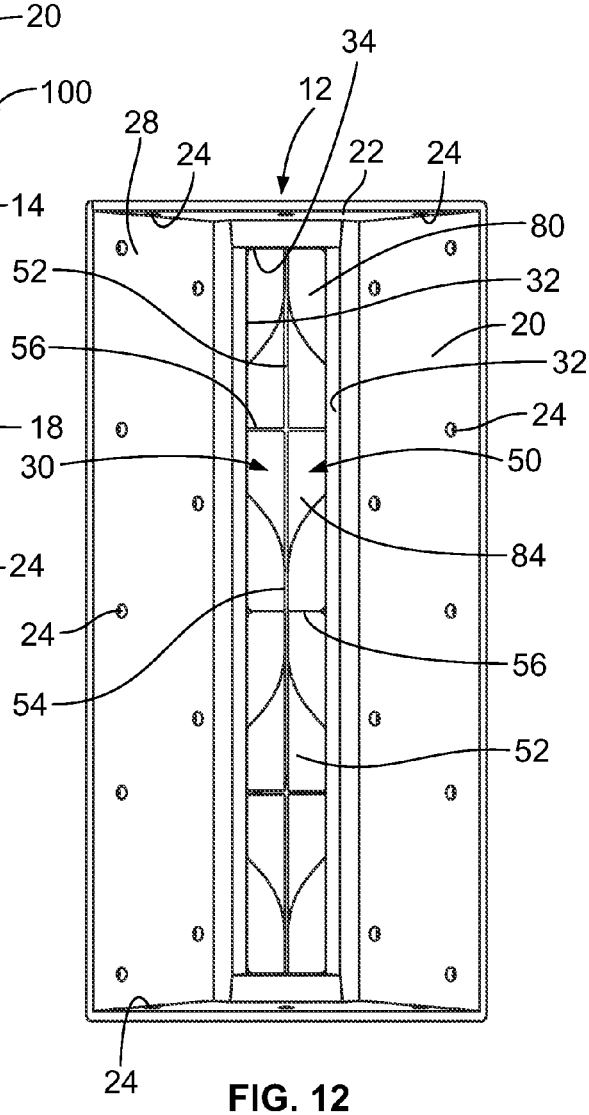
FIG. 12 is an optional intended use of the inventive phase plug device showing the front view of a dual phase plug device, in which two inventive units are disposed in a longitudinally stacked column, with the longitudinal axis of the output apertures aligned in a loudspeaker system having a common horn structure.

As can be most clearly seen in of FIGS. 4A, 4B, 12 and 15, retaining support surfaces 54, 56 for retaining the insert 50 in position within the chamber 80 are shown in each of the embodiments. Referring again to FIG. 4, the insert 50 includes an edge 58 that is a terminal meeting line for the two surfaces 52, one left and one right of the wedge shaped portion 55. Reference to FIGS. 4A, 4B and 12 will show that the surfaces 54, 56 terminate at the sharp edge 58. Optionally, surfaces 54, 56 may terminate prior to or beyond the sharp edge 58. The sound energy is in the form of essentially two halves of a wavefront 79 to the left and right of the wedge shaped portion 55, and in the embodiment of FIG. 12, to the left and right of the support structure of the support surfaces 54. Additionally shown in FIG. 12 are support structures, in the form of continuous fins 56, extending along the "equator" of the insert 50 from the surface 52 to the corresponding position on the surface 82. Similarly, support structures in the form of fins 54 extend along the top and bottom of the insert 50 from the surface 52 to the corresponding position on the surface 82. Support surface fins 54, 56 are normal to the direction of prorogation of the wavefront through the conduit 83. As the sound wavefronts clear the edge 58, they must also clear the support surfaces 54, 56 before combining into a single planar wavefront 85.

The necessity should be understood for elimination of any discontinuous surfaces within conduit 83 that would cause diffraction of the sound and subsequently unwanted interference between the secondarily generated wavefronts from the diffraction with the original, primary wavefronts within the waveguide conduit 83. In accordance with these restrictions, one of the features provided by the present invention is that the point where the wavefront clears the last solid structure of the phase plug insert 50, that is, the edge 58 at the output aperture 69, the wavefronts 79 are synchronized and the sound energy emitted from the driver 62 reaches the edge 58, or as shown in FIGS. 4 and 12, also reaches the outer edge of the support structure 54, at precisely the same moment because the distances for all the paths leading from the entry apex 47 to the edge 58 are identical in length as calculated with reference to the equations defining the structure and path lengths below.

Significantly, the omission of any discontinuities from the surfaces 52, 82 within the conduit 83, eliminates spurious artifacts, such as reflections of the diffracted energy within the conduit 83. Those reflections that result from discontinuities found within similar conduits of prior art devices tend to result in constructive and destructive interference with the primary wavefront due to the reflected waves. Thus, the spectral content of the resulting wavefront emanating from the output aperture of the prior art devices is altered significantly from the spectral content at the input aperture.

Figure 13:
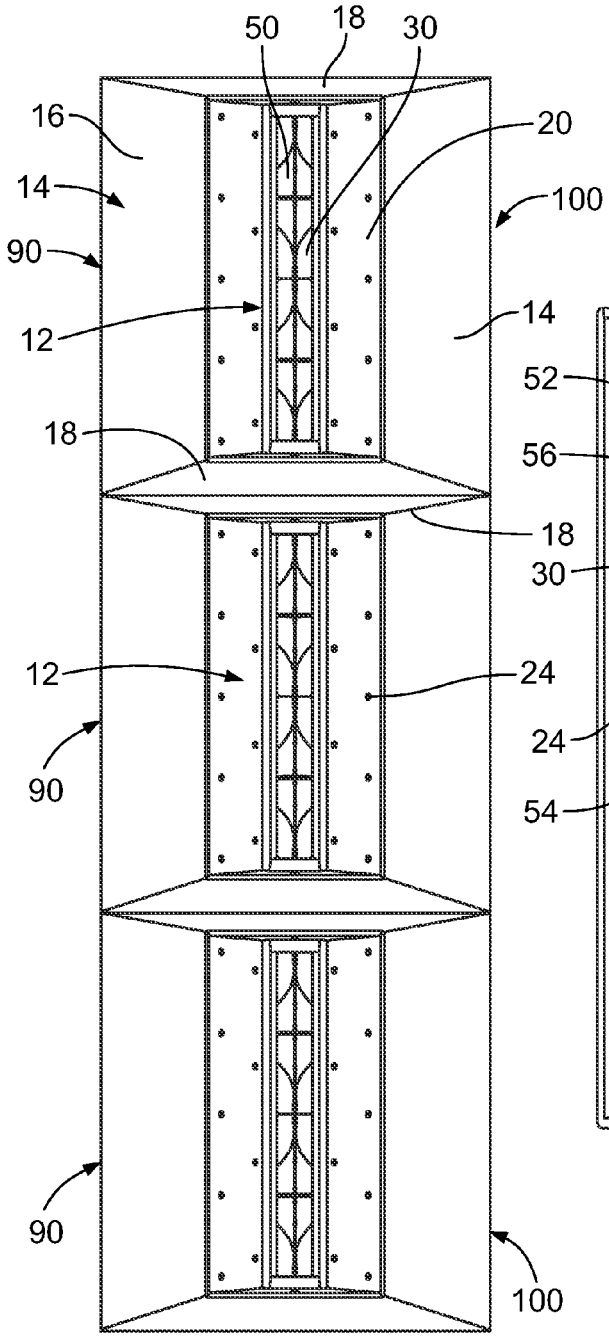
FIG. 13 is an optional intended use of the inventive phase plug device showing a multiple phase plug device in which several of the inventive dual phase plug units, similar to those shown in FIG. 12, are disposed in a vertically stacked column with the longitudinal axis of the output apertures aligned in a loudspeaker system, and having an optionally common aligned horn structure.
Figure 15:
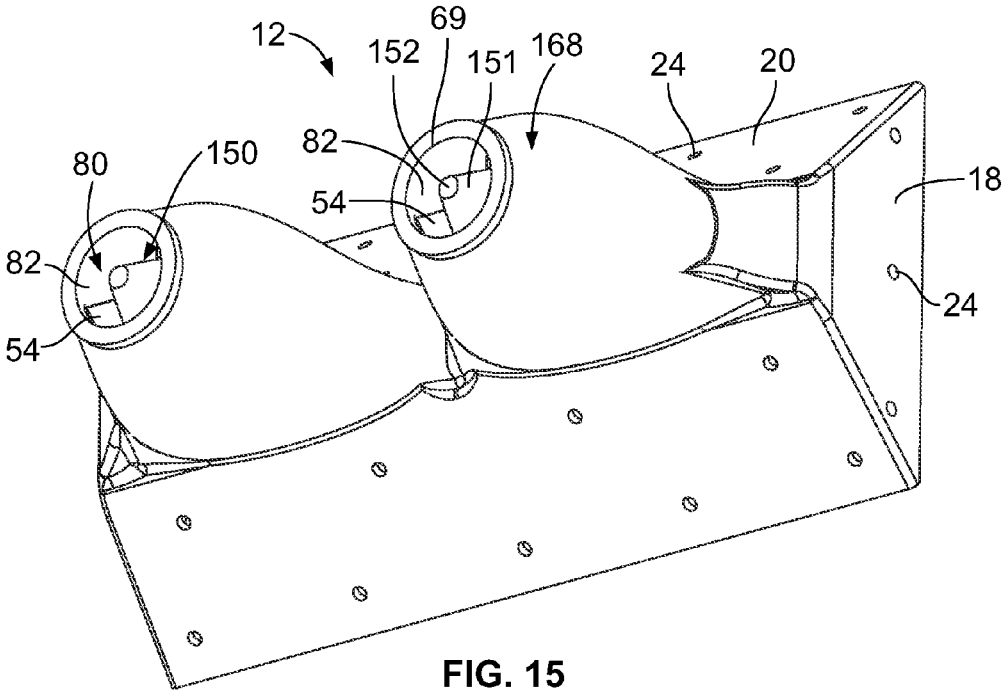
FIG. 15 is a isometric view of the dual phase plug device as shown in FIGS. 12 and 14, the device utilizing two inventive phase plugs in the environment of a loudspeaker assembly, with an alternative embodiment of the inventive phase plug insert.

The support surfaces are shown at the right side of the phase plug 68, as best seen in FIG. 4A and to some extent in FIGS. 12, 13 and 15, serve to position and support the insert 50 within the chamber 83. The supports are of two types, horizontal supports 56 that position the insert so that it retains its position in the horizontal direction (the y-direction in FIG. 2) and vertical supports 54 that terminate in edge 58 support the insert 50 in the vertical direction (the z-direction in FIG. 2). Supports 54, 56 are shown in the form of thin slats 54, 56 having surfaces that are normal to the propagation of the sound wave so as to eliminate as much as possible any obstructions that could create diffraction of the wavefronts or other artifacts of acoustic discrepancies. It is contemplated, although not preferred, that the supports may take other shapes, such as oval, diamond, circular or other shaped posts (not shown) that are arrayed in conduit 83 and retain the position of the insert 50 in place. However, these types of supports are not preferred because any shape that presents a surface that is not perfectly normal to the propagation of the wavefront will reflect or diffract at least some sound in a direction different from that of the main wavefront, and may result in the spectral content sound exiting from the output aperture 30 to be different than that of the sound entering the input aperture 69, which is to be avoided.

Referring again to FIGS. 4A, 4B, 12, 13 and 15, the supports 54, 56 are shown to extend from a leading edge 57 about one-eighth of the distance L within the conduit 83, as measured from aperture 69 to aperture 30, each at their respective ends of conduit 83. Thus, although a minimal amount of sound may be reflected and/or diffracted from the initial contact point of the sound wave at leading edge 57, the remainders of the fins 54, 56 are exactly normal to the wavefront prorogation, and thus do not diffract or reflect any sound. The fins 54, 56 are preferably as thin as possible to provide as little obstruction as possible, and the longitudinal surfaces defining the fins are parallel to each other and to the sound propagation direction. As shown in FIG. 4A and more clearly in FIG. 4B, the fins 54, 56 extend from surface 52 to surface 82 and have no intervening openings or other discontinuities.

Referring again to FIGS. 1-4, it can be appreciated that the diameter of the circular input aperture 69 will, in part, determine the separation distance W (FIG. 5) between surfaces 52, 82. Similarly the width of the output aperture 30 will for the most part be the identical to the diameter d of the input aperture 69. Optionally, to produce desired characteristics in the output wavefront, the output aperture width may be smaller or larger than the diameter d. The impetus for precise definition of the contour of surface 52 is so that the path lengths that the sound travels will yield the desired wavefront curvature at the output aperture 69. That contour of surface 52 and the corresponding contour of the inner wall surface 82 of the chamber 80 are precisely defined by several mathematical formulas which will be described in greater detail below. The equations provide for an a priori determination of the exact linear dimension of the longest path $r_{max}$ through the conduit 83, at all times following the curvature of the surfaces 52, 82 for the reasons stated above.

Referring specifically to FIG. 4, the propagation of wavefronts 79 through the conduit 83 is described in detail. FIG. 4 is a cutaway view of the insert 50 viewed in plan from the top within the chamber 80 of the phase plug device 68 defined by the inner surface 82. The cross-section is taken approximately along a plane through the center of the insert 50, essentially the x-y plane in the view shown in FIG. 2. While the two dimensional rendition shows the wavefronts 79 as wavy lines, it should be understood that the lines extend into the plane of the drawing and are in fact annular fronts that propagate through the waveguide defined by conduit 83. The path from the input aperture 69 to the output aperture 30 must necessarily travel through the waveguide conduit 83 formed by the insert surface 52 and the inner surface 82 of the chamber 80. Each shortest path through the conduit 83 will be of substantially equal length to any other shortest path in order to form a planar wavefront at the exit aperture 30. Thus, the paths at smaller angles $\phi$ require additional lengthening than paths at larger angles $\phi$ in order to provide a single path length dimension r for all paths F through the conduit 83. The present invention provides for this feature by increasing the path length in the horizontal direction for the smaller angles $\phi$, and thereby forcing the sound to traverse a path with a larger elliptical orbit around the central ovoid portion 53 and reducing the vertical deviation for larger values of angle $\phi$ by reducing the size of the elliptical orbit.

One inventive feature of the present phase plug device 68 is the precise mathematical description of the path lengths F (FIG. 5) extending from the input aperture 69 to the output aperture 30, and the measurement of all the possible path lengths of the propagated wavefront 81, 79 through the conduit 83. It would be possible to have an otherwise shorter path length through the device in the absence of the insert 50. However, with insert 50 disposed within the chamber 80, the most direct and straight line measurement of the path length from the input aperture 69 to the vertically longitudinal end 31 of the oblong output aperture 30 results when that path length $r_{max}$ is measured along edge 44, shown schematically in FIG. 5. In the absence of the insert 50 in the chamber 80, this in fact would be the longest path length $r_{max}$, through the conduit 83—the shortest would be the path directly along the centerline CL. To make the specified path lengths all equal to $r_{max}$ for all the paths through the conduit 83, the insert 50 is shaped and dimensioned in accordance with mathematical descriptions below to extend the paths appropriately through the conduit 83. Thus, the path lengths F extending along the side paths through the conduit 83 will be lengthened by an appropriate amount to render them essentially to equal the path length of the longest path $r_{max}$ as defined below along the upper and lower edge 44 of the insert 50 as viewed in FIGS. 2 and 5.

It should be understood, however, that the embodiments shown in FIGS. 1-5 assume that the longest path length will be $r_{max}$. However, the path traveled need not necessarily all have the same path length for different angles, as shown, but may have a variable path length (not shown) so as to provide for desired effects of the wavefront curvature at the output aperture. For example, if a slightly convex wavefront is desired at the output aperture 30, the path lengths toward the ends 31 can be defined to be just slightly longer, thus radiating the wavefront at positions closer to the center (top-to-bottom) from the output aperture 30 slightly before it is radiated at the positions farther away from the center of the aperture 30. This allows for a change in the curvature of the wavefront exiting the device 68 at aperture 30 to a more convex one than the wavefront that entered the device at aperture 69. Similarly, the length of the most direct path through the more centrally disposed sections of the conduit 83 can be made longer than the length of the most direct path through the top or bottom section of the passage, resulting in a more concave wavefront exiting the device than a wavefront that would result from path lengths identical to $r_{max}$. These parameters are understood to provide a much greater flexibility in designing various types of phase plugs for specific applications. The parameters will be set forth in greater detail below.

Figure 5:
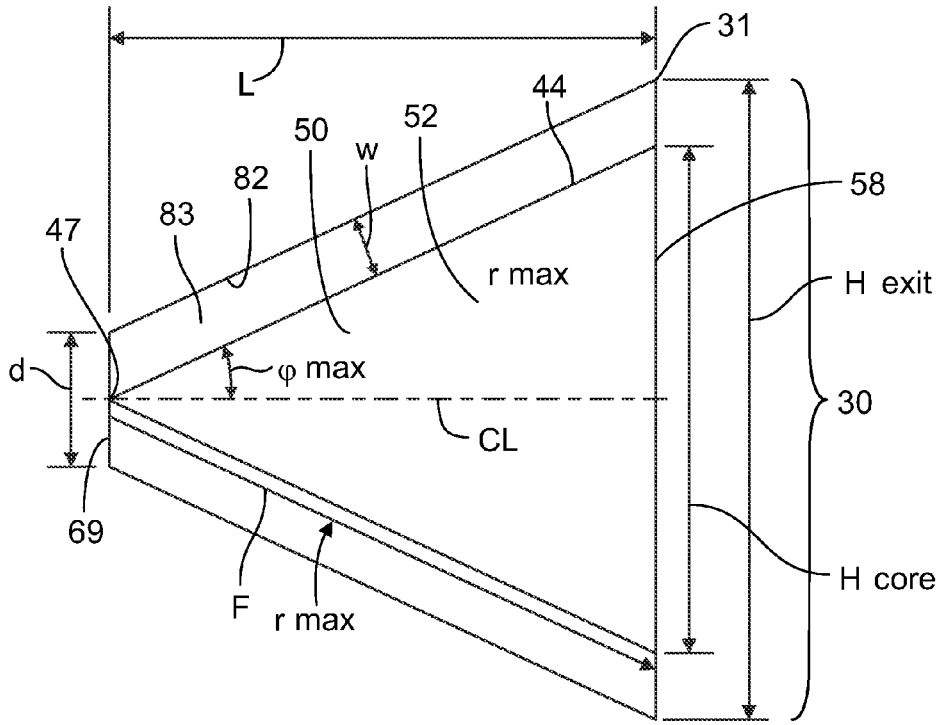
FIG. 5 is a schematic side view of an inner cross-section of the phase plug according to the present invention.

Referring now to FIG. 5, a schematic diagram of the phase plug 50 is shown in a side view, so as to define the necessary parameters for the mathematical equations of phase plug insert 50 and surface 82 of chamber 80. For purposes of clarity, this view does not show all the details of the curved surfaces 52, 82 shown in detail in FIGS. 1-4. As can be seen in FIG. 5, the output aperture 30 will be set by the desired application of the loudspeaker in which the device 68 will be used. Although the length L of the device 68 can be varied somewhat, the range of the angle $\phi_{max}$ being between 5° to 85°, a preferred range of from 10° to 40° and an optimal range of from 20° to 30°. It has been observed that angles less than about 30° for $\phi_{max}$ are more readily suited for the methods proposed for this invention. However, solutions for angles of $\phi_{max}$ greater than about 30° are more difficult and may not provide for inserts, such as insert 50, having suitable shapes.

The design of a phase pug device 68 in accordance with the present invention requires a number of predetermined input parameters, which may be variable within a predetermined range, such as L and $\phi_{max}$ discussed above. These parameters are preset by the requirements of the loudspeaker application. The parameters include the entry dimension, that is, the diameter d of the input aperture 69, the height $H_{exit}$ of the exit or the longitudinal dimension of output aperture 30, and overall length L of the phase plug 68, that is, the length of a line normal to the input and output apertures 30, 69 along the centerline CL between the apertures 69 and 30. From the preset dimensions of the parameters, a basic layout of the device can be drawn schematically, as in the side view shown in FIG. 5. The value of $r_{max}$ is an important consideration in the design of a phase plug device 68 in that it represents the longest contoured distance of a path F as measured from the input aperture 69 to the longitudinal end 31 of output aperture 30.

In FIG. 5, the following physical parameters are identified with the appropriate designations, so as to provide the values that will result in defining the shape of the surfaces 52, 82:

d=the diameter of circular input aperture 69

$H_{exit}$=total height of the output aperture 30 of the device, that is, the longitudinal dimension $H_{core}$=height of the insert core 50 at the edge 58 of the device 68

$\phi_{max}$=maximum angle relative to the centerline CL of the top or bottom surface 52 along path 44 (FIGS. 1, 2 and 5) of the insert core 50 of the phase plug 68

$r_{max}$=length of the top or bottom surface 52 along path 44 from the input aperture at apex 47 to the output aperture adjacent edge 58

L=overall horizontal length of the phase plug 68, that is, the length of a line normal to the input and output apertures 30, 69 along the centerline CL between input aperture 69 and output aperture 30

From the schematic depiction in FIG. 5, we can derive the following relationships.

$$\varphi_{max} = \tan^{-1}\frac{H_{core}/2}{L} \quad \text{(a)}$$

$$r_{max} = \frac{L}{\cos\varphi_{max}} \quad \text{(b)}$$

The shortest possible path through the phase plug 68, for which the value of $\phi$ is 0°, would be measured along the centerline CL and in the absence of the insert 50. This distance would be essentially equal to L shown in FIG. 5, and would be much shorter than any other path that is measured therethrough. However, since the phase plug insert 50 forces the sound energy to travel around the obstruction presented by the surfaces 52 of insert 50, and especially around the central transitional portion 53 which has been shaped and dimensioned to provide a lengthening function to the path r. That is to say the shorter path r is lengthened to the path $r_{max}$ by restraining the wavefront to follow waveguide 83, and indeed, to restrain all the paths F to have a common length equal to $r_{max}$. The distance of any single path F, and all other paths F within the range $0° \leq \phi < \phi_{max}$, must be increased to make them all equal to that of $r_{max}$. That is, each path F through the phase plug device 68 must be the same length as that of the longest possible path $F=r_{max}$. As described above, this is necessary to ensure that all the sound energy generated by the compression driver 62 and entering aperture 69 (FIG. 1) at a specific moment of time will travel an equal length so that each sound wavefront reaches the output aperture 30 simultaneously irrespective of the path traveled. This is accomplished by using sections of ellipses and lines tangent to the sections of ellipses to form the increased path length F, as described below in several series of equations. A different ellipse will be required for each incremental value of $\phi$. This results from the angle being taken between the two extremes, that is, between $\phi=0$ and $\phi=\phi_m$. When $\phi$ equals $\phi_{max}$, an ellipse is no longer needed as the path is defined as the maximum path $F=r_{max}$ as shown in FIG. 5.

The equations to create discrete path lengths, F, all equal to $r_{max}$, using a portion of an ellipse E defined thereby, and for predetermined lines t and t' tangent to the ellipse, are set forth below, in reference to FIG. 6, where the dimensions are defined by the desired objectives of the device applications. The ellipse E, shown in FIG. 6, having the tangent lines t, t' can be considered as a schematic representation of one section of a phase plug insert 50 taken along a cross-section angle $\phi$ according to the present invention as viewed normal to the cross-section taken along the angle $\phi$. The distance L, the straight line distance between the apertures 30, 69, is equal to the length of the desired phase plug device 68 when the angle $\phi=0°$. The distance L also happens to be the dimension between two directrices $D_1$ and $D_2$ of the ellipse E.

The elements and characteristics of an ellipse are well-known, but are repeated herein for clarity of this disclosure. An ellipse is a smooth closed curve which is symmetric about its horizontal and vertical axes, referred to as the major and minor axes. The distance between antipodal points on the ellipse, or pairs of points whose midpoint is at the center of the ellipse, is maximum along the major axis, or transverse diameter (extending horizontally in FIG. 6), and minimum along the perpendicular minor axis, or conjugate diameter (extending vertically in FIG. 6). The semi-major axis (denoted by a in FIG. 6) and the semi-minor axis (denoted by b in FIG. 6) each are one half of the major and minor axes, respectively. The focus points always lie on the major axis, and are spaced the distance c equally on each side of the center of the ellipse point C. The circumference of the ellipse E thus relies of the position of the foci around which the elliptical shape is drawn. While one method of defining the characteristics of an ellipse is in relation to the foci and the distance between them, other alternatives exist for representing the ellipse. These may provide a better method of measurement and calculations of other properties of the particular elliptical shape that defines the central transitional portion 53, and provide an easier means for calculations of the shape of the phase plug insert 50.

In context to the central transitional portion 53 of the phase plug insert 50, appropriate variances in the semi-major and semi-minor axes will result in changes to the ultimate length of a specified path through the conduit 83 when following the contour of surface 52 partially defined by the ovoid shape of the portion 53. The preferred method of calculating the characteristics of an ellipse can be set forth by reference to the length of the semi-major and semi-minor axes a and b. The eccentricity e may be defined by the following formula:

$$e = \varepsilon = \sqrt{\frac{a^2 - b^2}{a^2}} \tag{c}$$

For any ellipse, the eccentricity is between 0 and 1 ($0<e<1$). When the eccentricity is 0 ($e=0$), that is $a=b$ in the equation above, in which case the two axes a and b have the same value, the elliptical figure E becomes a circle. As the eccentricity e tends toward 1, the ellipse E takes on a more elongated or flattened shape, until it becomes a straight line when the value of the semi-minor axis b reaches 0.

This is significant in the context of the representation of a cross-section as shown in FIG. 6, because as the angle $\phi$ increases from the value where $\phi=0$ and toward the value of $\phi=\phi_{max}$, the ovoid shape of the central portion 53 is reduced in size because the axes a and b become smaller to accommodate the lesser amount of lengthening of the path length F required. When $\phi=\phi_{max}$, the ovoid character of the central portion is essentially eliminated and the edge of the two surfaces 52 of the central portion 53 intersect at a lateral edge 44 (FIG. 3) that is essentially the straight line path $r_{max}$. That is, the path of $r_{max}$ follows the edge of the conical surface of conical portion 51, and then the straight line edge 44 of the transitional central portion 53 until it reaches the wedge shaped edge 58 that terminates the wedge shaped portion 55. However, it should be understood that for values of $\phi$, between the extremes of $\phi=0$ and $\phi=\phi_{max}$, the central ovoid 50 section provides for different paths, all with the same path length, $r_{max}$. The cross sections shown in FIGS. 7B, 8B, 9B, 10B, and 11B illustrate the progressive decrease in the lateral component in the path of travel, F. This is due to the increase in the vertical component in the path of travel, F, the vertical component being defined in the direction at which the angle $\phi$ is taken for each cross section. The decreasing lateral component and increasing vertical component complement each other so that all of the paths of travel are of the same length, $r_{max}$.

Referring again to FIG. 6, the relationships between the different elements of the ellipse E, defining the general cross-sectional shape of the central portion 53, are set forth below. The ellipse E is first circumscribed by a circle having a center which coincides with the center of the ellipse, the radius of which equals the length of the semi-major axis a of the ellipse. Above, it was previously stated that the distance between the two directrices of the ellipse, $D_1$ and $D_2$, equals the length of the device, L. This allows us to write the following relationship.

$$2(c+p/e)=L \tag{d}$$

By using the following commonly known relationships for ellipses:

$$p=b^2/a \tag{e}$$

$$e=c/a \tag{f}$$

where:

p is the semi-latus rectum of the ellipse c is the distance from the center of the ellipse to the focus of the ellipse along the semi-major axis a we can solve for the semi-minor axis, b, as a function of the semi-major axis, a, and the length of the device, L.

$$b=\sqrt{a^2-4a^2/L^2} \tag{g}$$

With the length of the device L fixed, this equation completely parameterizes an entire series of different ellipses based on the value of the semi-major axis a of the ellipse. Once b is calculated for a particular value of a, the value of all the other parameters of an ellipse may be calculated. We can use this to calculate c, e, and p according to the equations above. These values determine the location of the semi-latus rectum (p in FIG. 6) of the ellipse E, which is the point where the tangent lines t and t' intersect the ellipse E. This is the preferred point of intersection, but other points on the ellipse may also work, as described below with reference to FIG. 6. Since we know p and e, we can calculate the angle of the tangent lines, t, with respect to the semi-major axis, a. We can also calculate the length of the tangent lines, t, t', from the directrix to the intersection of the ellipse E. Each of these equations are set forth below:

$$\theta_{Tangent\ Line}=\tan^{-1}\left(\frac{p}{p/e}\right)=\tan^{-1}(e) \tag{h}$$

$$t=\sqrt{p^2+(p/e)^2} \tag{i}$$

There is no known closed form solution for calculating an arc of the perimeter of an ellipse. This makes calculating the length of only a segment of an ellipse troublesome. However, an approximation of the arc length of the perimeter of an ellipse has been published by David Cantrell in 2002. This approximation may be used to find the arc length of a section of an ellipse generally, and for a close approximation of the arc length traversing the central ovoid portion 53 of the inventive phase plugs in particular. This approximation is valid for an arc length defined by a point on the ellipse and the nearest intersection of the semi-minor axis, b.

Again referencing FIG. 6, the arc length of the ellipse between the tangent lines, t, on each side of the semi-major axis, b, is the length needed to be determined for each path F. We can define $\theta_{circle}$ as the angle from the semi-major axis, b, to the line connecting the center of the ellipse with the point on the circumscribed circle at which the projection of the semi-latus rectum, p, intersects the circumscribed circle. Cantrell's approximation, which is sufficient for our purposes here, for the arc length from the intersection of the tangent line, t, to the semi-major axis, b, is given by the equation (j) below with the angle $\theta_{circle}$ being in radians. The path length F from the beginning of tangent line, t, located at the input aperture 69 (at the intersection of the leftmost directrix $D_1$ in FIG. 6, corresponding to the apex point 47 of the conical portion 51), to the end of the other tangent line segment, t' (at the intersection of the other rightmost directrix $D_2$, corresponding to the edge 58), is given by the equation (k) below:

$$S=a*(\sin\theta_{circle}+(\theta_{circle}-\sin\theta_{circle}))*(b/a)^{(2-0.216*\theta_{circle}^2)} \tag{j}$$

where:

$\theta_{circle}$ is the angle from the semi-major axis, b, to the line connecting the center of the ellipse with the point on the circumscribed circle at which the projection of the semi-latus rectum, p, intersects the circumscribed circle; and S is the arc length of the section of the ellipse between the intersection of the semi-latus rectum, p, and the semi-minor axis, b.

The path length F (FIGS. 7A-11B) from the beginning of tangent line t (at the intersection of the directrix $D_1$, apex point 47 in FIGS. 1-4 and 6) to the end of the other tangent line t (at the intersection of the other directrix $D_2$, edge 58 in FIGS. 1-4) is given by the equation (k) below:

$$F=2*(t+S) \tag{k}$$

As previously stated, by setting the following condition, specifically that the path length of all paths F are equal to $r_{max}$, the phase plug device 68 will function as desired. The following equation (l) merely states this mathematically.

$$r_{max}=F=2*(t+S) \tag{l}$$

Because S is dependent on a, b, and $\theta_{circle}$ (which is also dependent on a and b) it would be very cumbersome, if not impossible, to derive an analytic solution for a as a function of $r_{max}$. Therefore, each ellipse E which is used to join the cone-shaped portion 51 at one end and the wedge-shaped portion 55 at the other end of the invention must be calculated individually based on the value of $\phi$ as it varies from $\phi=0°$ to $\phi=\phi_{max}$. An iterative process of varying the value of a so that the path length F converges to $r_{max}$ can be utilized to determine the correct ellipse for each value of $\phi$.

The method of determining the shape and physical dimensions for an acoustic conduit of a sound energy waveguide further require defining both surfaces 52, 82 of the conduit 83, and especially where these surfaces relate to the central ovoid portion 53 of the inventive phase plugs. Thus, the surface 52 requires a reiterative calculation of the values of a and b as these are used to calculate the value of F. This reiterative calculation further comprises the steps of utilizing an estimated value of a to provide a value of F, comparing the difference in the value of F derived by inserting the estimated value of a with the determined path length $r_{max}$, determining a new estimated value of a that provides a closer compared difference between the value of F and $r_{max}$, reiterating the immediately preceding above two steps until the difference between the calculated values of F and $r_{max}$ produce a negligible difference; and utilizing the value of a that produces the value of F in the last iteration in establishing the physical parameters (a,b) of the ovoid central section of the insert for the particular specified cross section angle $\phi$ being calculated.

Fixing the length of the device L, that is, the distance between the two directrices $D_1$ and $D_2$, allows equation (g) above to completely parameterize an entire series of different ellipses $E_0$ $E_1$, $E_2$, etc., based on the different values of the semi-major axis a, thereby providing the desired semi-minor axis b of the ellipse E. Thus, the semi-major axis a can be varied as needed to produce the desired path lengths F for each angle $\phi$. With the parameter a determined for a particular angle $\phi$, the ellipse E can be used to produce the necessary contour lines of the three separate portions, that is the tangent t and t' at either end of the central ovoid portion 53, as well as the desired ellipse E. Thus, the equations can be used to calculate the ellipse that will result in the path length F to equal to $r_{max}$.

If curvature is desired in the wavefront, that is, a different wavefront shape from a planar wavefront, it can easily be incorporated into the inventive device. Since the calculation of each ellipse to get the required path length is based on the angle $\phi$, above and below the horizontal, it is very convenient to specify the angular curvature of the wavefront. Once the height of the device $H_{exit}$ (FIG. 5) has been chosen, this angular curvature can be used to calculate the desired radius of curvature for the wavefront as it exits the aperture 30 (FIG. 4). This, in turn, can be used to calculate the change in path length needed to realize the desired wavefront curvature. Each ellipse can then be calculated to yield this modified path length of the different paths F. The relevant equations for obtaining a desired amount of curvature in the wavefront are set forth later in the description.

Referring now to FIGS. 7A-B through 11A-B, the description below provides for the method of obtaining a planar wavefront, along the vertical dimension. To obtain the surface contour curvature of the surface 52 according to the present invention, which defines one surface of the waveguide creating conduit 83, several of the path lengths F are calculated for different angles $\phi$, ranging from $\phi=0°$ to $\phi=\phi_{max}$. The path lengths F discussed below are for incremental increases in height ($H_1, H_2, H_3, \ldots H_{max}$) at the exit aperture that are about 0.50 inches (12.7 mm) apart. Many more data points, that is, additional paths can be described by varying the angle $\phi$ at increments that are less than the 0.50 inch (12.7 mm). For example, 0.250 inches (6.35 mm) increments have been found to provide a very good rough surface approximation for the surface 52, and the interpolations between them more easily provide the desired surface contour of insert 50.

The tangent lines t on the left side of FIG. 6 represents the edges of the conical portion 51. Similarly, the tangent lines t' at the right side represent a cross section of a smooth surface from the points P' as taken tangentially from the points P' on the ellipse E to the edge 58, where the two segments t' intersect. The ellipse E should be considered as a cross-section of the central portion 53 essentially following a path F along 52.

Figure 7A:
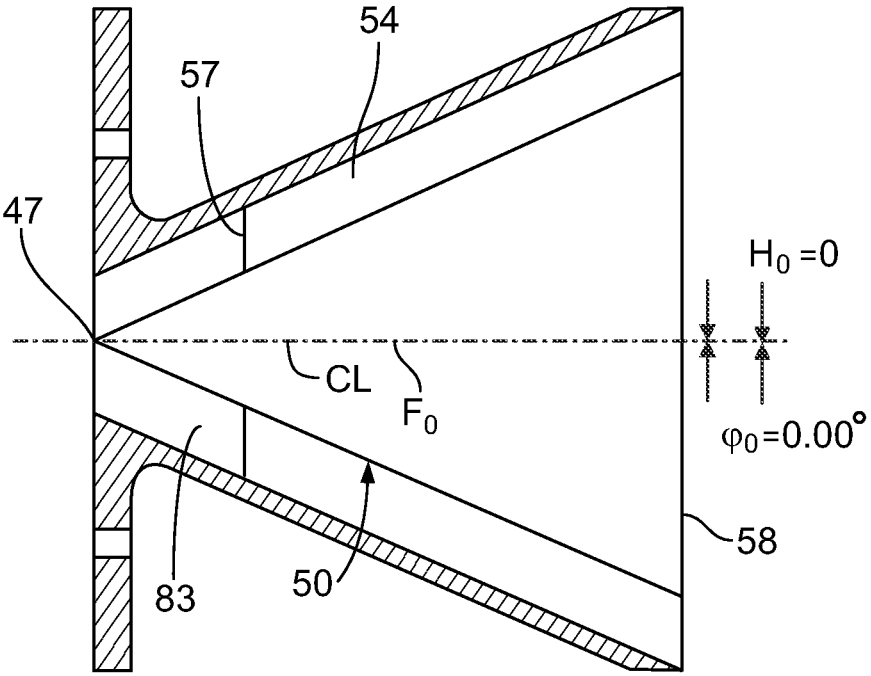
FIGS. 7A and 7B are side and plan cross-section views, respectively, of the inventive phase plug according to the present invention, with the cross-section taken approximately at a given angle $\phi_0$ equal to approximately 0° relative to the horizontal centerline CL, showing the path $F_0$ extending through the waveguide.
Figure 7B:
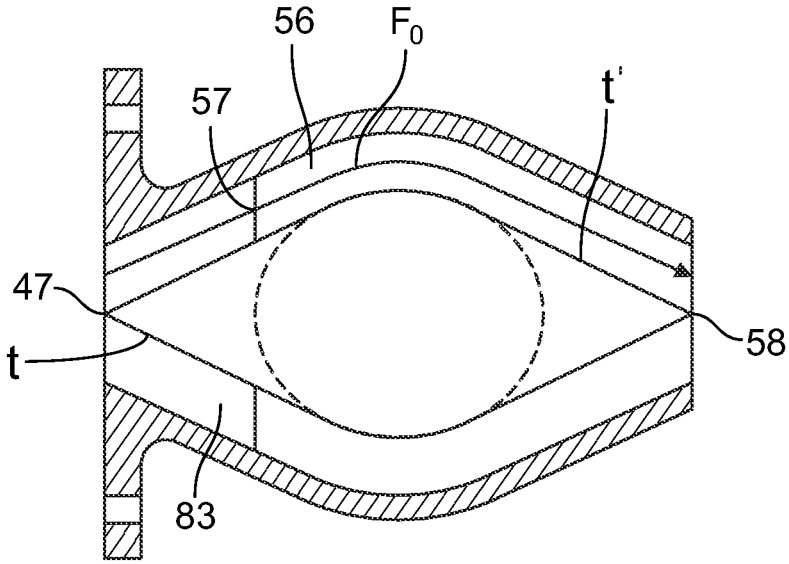

FIGS. 7A and 7B are cross-section side and schematic top cutaway plan views, respectively, of the inventive phase plug 68 according to the present invention, showing the shortest path through the waveguide at a given angle $\phi_0$ equal to approximately 0° relative to the horizontal centerline CL extending through the center of the insert 50. As is seen in FIG. 7B, the central transitional portion 53 of the insert 50 is the furthest outward extent of the ellipse because the path $F_0$ at $\phi_0=0°$ requires the largest additional path extension due to the direct line path (that is, the path that would follow the centerline CL in the absence of insert 50) being the shortest.

Figure 8A:
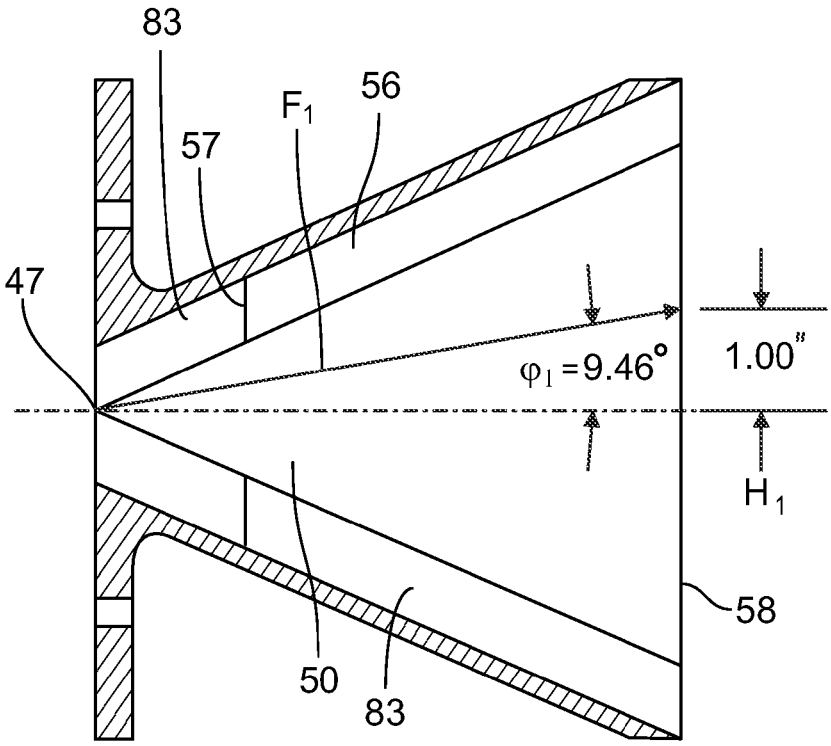
FIGS. 8A and 8B are side and plan cross-section views, respectively, of the inventive phase plug according to the present invention, with the cross-section taken approximately at a given angle $\phi_1$ equal to approximately 9.46° relative to the horizontal centerline CL, showing the path $F_1$ extending through the waveguide.
Figure 8B:
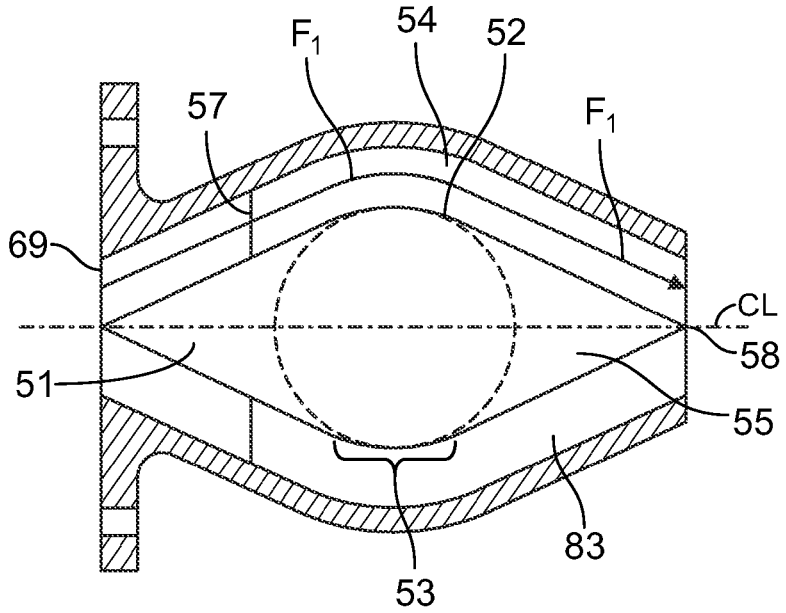

FIGS. 8A and 8B are cross-section side and schematic top cutaway plan views, respectively, of the inventive phase plug according to the present invention, showing the path through the waveguide 83 at a given angle $\phi_1$ equal to approximately at 9.46° relative to the horizontal centerline CL. The angle $\phi_1$ is calculated to provide a height relative to the horizontal centerline CL of about 1.0 inch (25.4 mm) at the output end. As can be seen from the slightly smaller dimensions of the ellipse in FIG. 8B, the increased length of the sound propagation to the aperture 30, caused by the detour of the conduit 83 around the central ovoid portion 53, is not as large. This is because the angle $\phi_1$ provides a small additional distance in being diverted vertically toward the longitudinal end 31 of the aperture 30 (FIG. 8A).

Figure 9A:
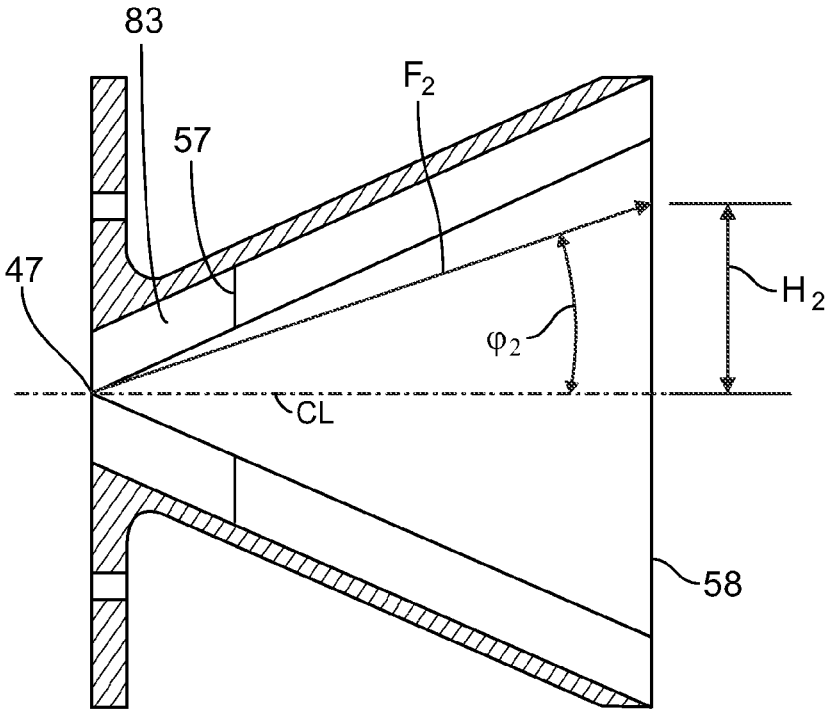
FIGS. 9A and 9B are side and plan cross-section views, respectively, of the inventive phase plug according to the present invention, with the cross-section taken approximately at a given angle $\phi_2$ equal to approximately 18.43° relative to the horizontal centerline CL, showing the path $F_2$ extending through the waveguide.
Figure 9B:
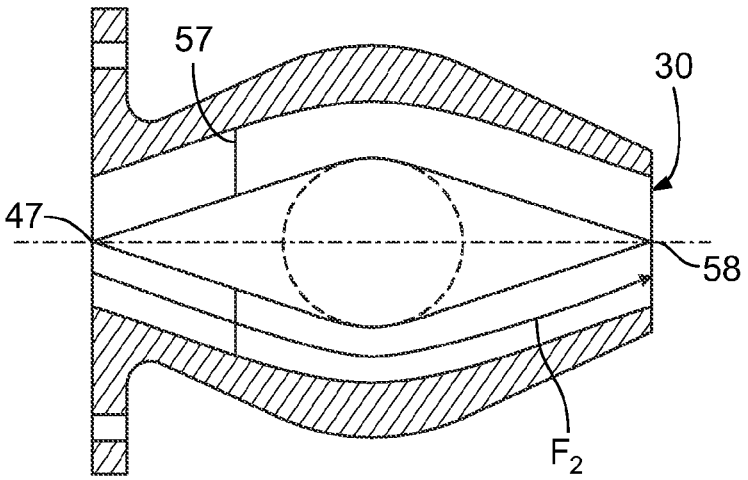

FIGS. 9A and 9B are cross-section side and schematic top cutaway plan views, respectively, of the inventive phase plug according to the present invention, showing the shortest path through the wave guide at a given angle $\phi_2$ equal to approximately at 18.43° relative to the horizontal centerline CL. The angle $\phi_2$ is calculated to provide a height relative to the horizontal centerline CL of about 2.0 inches (50.8 mm) at the output end.

Figure 10A:
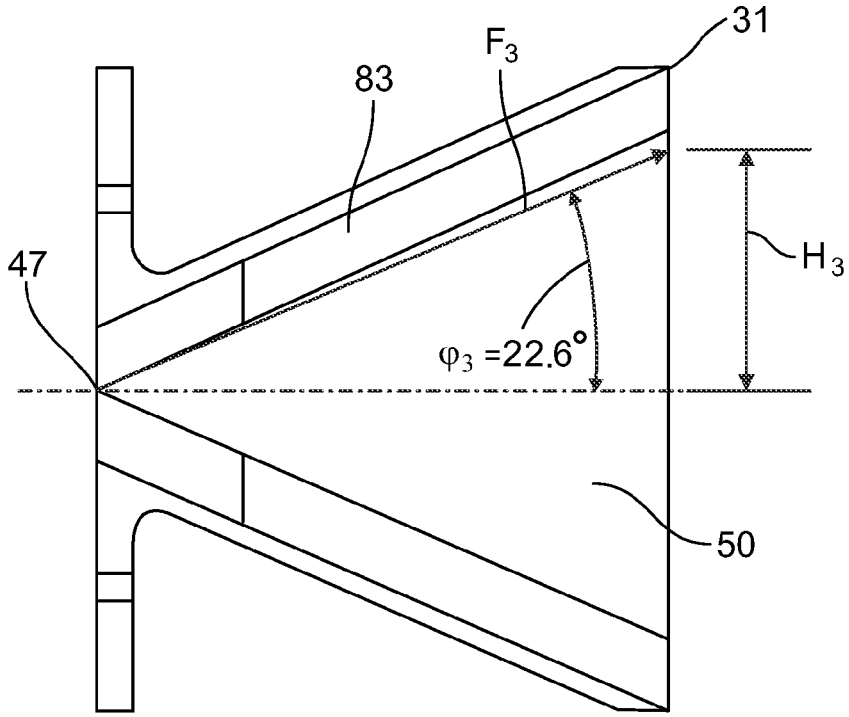
FIGS. 10A and 10B are side and plan cross-section views, respectively, of the inventive phase plug according to the present invention, with the cross-section taken approximately at a given angle $\phi_3$ equal to approximately 22.82° relative to the horizontal centerline CL, showing the path $F_3$ extending through the waveguide.
Figure 10B:
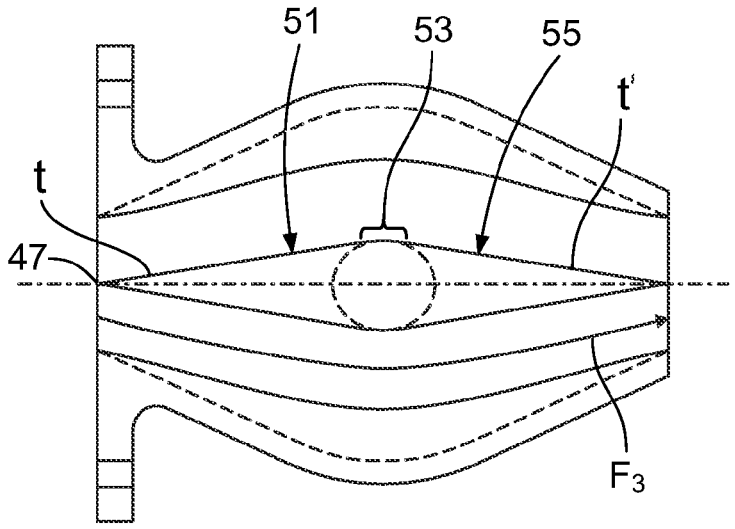

FIGS. 10A and 10B are cross-section side and schematic top cutaway plan views, respectively, of the inventive phase plug according to the present invention, showing the shortest path through the wave guide at a given angle $\phi_3$ equal to approximately at 22.82° relative to the horizontal centerline CL. The angle $\phi_3$ is calculated to provide a height relative to the horizontal centerline CL of about 2.50 inches (63.5 mm) at the output aperture 30. It should be noted that as the longitudinal end of the aperture 30 is approached in FIG. 10A, the transitional central portion 53, and the semi-minor axis of the ellipse, of FIG. 10B are much smaller than the semi-minor axis shown in FIG. 7B.

Figure 11A:
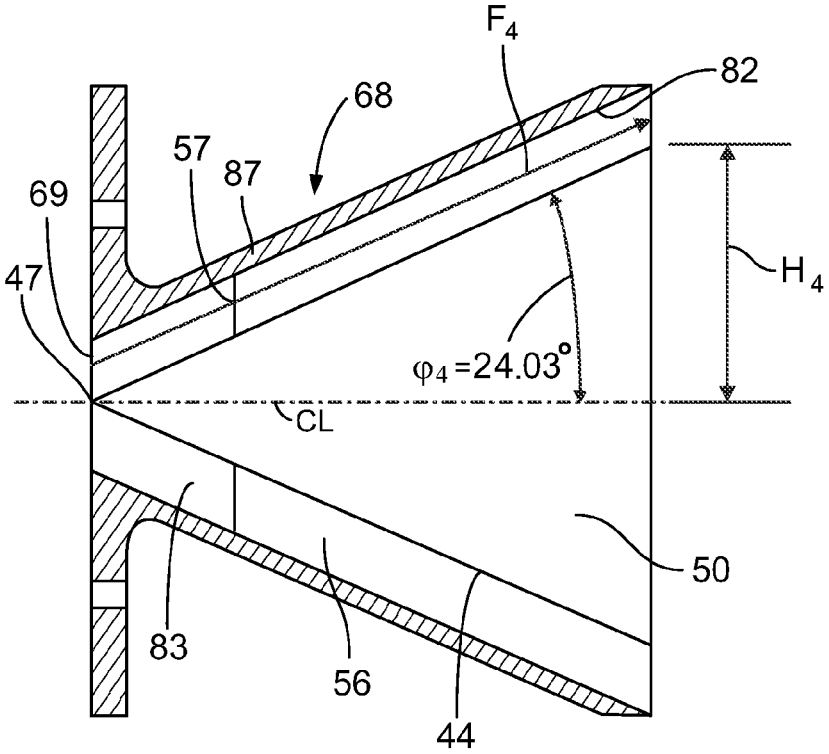
FIGS. 11A and 11B are side and plan cross-section views, respectively, of the inventive phase plug according to the present invention, with the cross-section taken approximately at a given angle $\phi_4$ equal to $\phi_{max}$ equal to approximately at 24.03° relative to the horizontal centerline CL, showing the path $F_{max}$ extending through the waveguide.
Figure 11B:
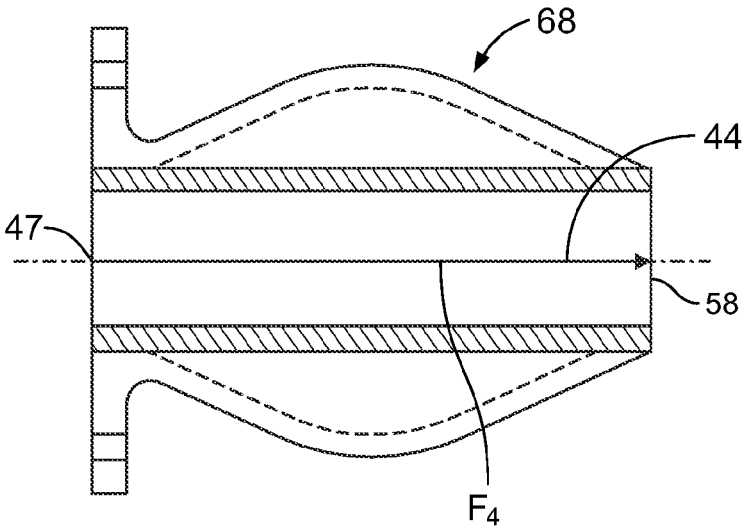

FIGS. 11A and 11B are cross-section side and schematic top cutaway plan views, respectively, of the inventive phase plug according to the present invention, showing the shortest path through the wave guide at a given angle $\phi_{max}$ equal to approximately at 24.03° relative to the horizontal centerline CL as defined above to provide the desired longitudinal dimension of the aperture 30. In most respects, the diagram of FIG. 11A is identical to that of FIG. 5. The angle of entry into the waveguide conduit 83 is at a straight line across the central section of the phase plug insert 50 to the output. The angle $\phi_{max}$ is a result of the device dimensions L (about 6.0 inches, 152 mm) and $H_{max}$ (about 2.675 inches, 67.9 mm). The shortest path follows the straight line along the surface 44 of the insert 50, extending in a straight line from input aperture 69 to output aperture 30.

It should be kept in mind that all of the paths are the same length at these angles, and indeed at all the angles between the calculated angles $\phi_0, \phi_1, \ldots \phi_{max}$. Thus, the shape of the curves provided by each of these paths can be calculated according to the formulas above, for as many angles $\phi$ as is desired, and the curves between the angles can be interpolated by known approximation functions. Indeed, while the heights $H_1, H_2, H_3 \ldots$ at the output end for the different angles $\phi$ are about one inch apart, these heights H can be taken at much smaller intervals to require less interpolation. The preferable interval of the difference in H is about 0.250 inch (6.35 mm), which provides an optimum height H between obtaining an approximate shape of the insert 50 while retaining the number of calculations to a reasonable number.

It should also be pointed out that the above description relies on knowing the length of the path $r_{max}$ to which all the other path lengths $F_0, F_1 F_2 \ldots$ through the conduit 83 should be set equal. The path $r_{max}$ is set ideally as a straight line dimension between the aperture 69 and the end 31 of the aperture 30. A shorter distance than a straight line for $r_{max}$ is not possible, but by changing the curvature of the line between the aperture 69 and the end 31, the length of $r_{max}$, and thus of all the other paths F, can be lengthened to some extent, providing a longer path length that may be defined as $r_{max}+G$, where G represents an added length dimension to all the path lengths F. All of the calculations by the equations above will retain the inventive features of the device 68. This can be done, for example, by making the path F of the "shortest" path length be a curved, rather than a straight lines as shown in FIGS. 5 and 11B. Although this is not a preferred method of practicing the invention, such a modification may be found desirable for purposes of a specific custom made loudspeaker design utilizing the inventive features of the phase plug 68, as described. Although the addition of an added length G to each of the path lengths F may add to the complexity of the equations above, there is sufficient information provided to complete the calculations above.

While the above descriptions for a phase plug device 68 comprises a single chamber 80, two of devices 68 can be utilized in tandem as a dual phase-plug device 12 (shown in FIG. 12), or in a stacked relationship (FIG. 13), to increase the volume and shape of the sound energy emitted by the stacked loudspeakers 90 utilizing the inventive phase plugs. However, each of the devices comprising the inventive phase plugs 68 should retain their ability to synchronize their respective wavefronts so that two or more phase plug devices, each being driven by separate drivers, will retain their synchronicity and produce a single wavefront emitted by the plurality of phase plug devices.

Referring now to FIG. 13, a plurality of commonly aligned loudspeakers 90 are shown in a representative stacked array 100. Each loudspeaker 90 comprises phase plug device(s) 12 attached to an associated horn 14. As shown in U.S. Pat. No. 6,581,719 to Adamson, which is incorporated fully as if referenced herein for a general discussion where appropriate, the horn sections 14 flare out from the output apertures(s) 30 of the phase plug device(s) 12. The horns 14 ideally are directed toward an audience or intended recipients of the sound waves emanating from the loudspeakers 90.

The stack of loudspeakers 90 are arrayed in a vertical direction separated at the borders by the horns 14. The loudspeakers 90 comprise horns 14, which are not a significant portion of the invention but will be described to illustrate the environment in which the inventive phase plugs are used. Horns 14 for each loudspeaker 90 comprise vertically extending sections 16 which flare outwardly in the horizontal plane and horizontally extending panels 18 which flare outwardly in the vertical plane, both of which are connected to their respective phase plug device(s) 12, as will be explained below. The individual loudspeaker assemblies 90 are separated by end horn panels 18, at opposed longitudinal ends of each loudspeaker 90.

Figure 14:
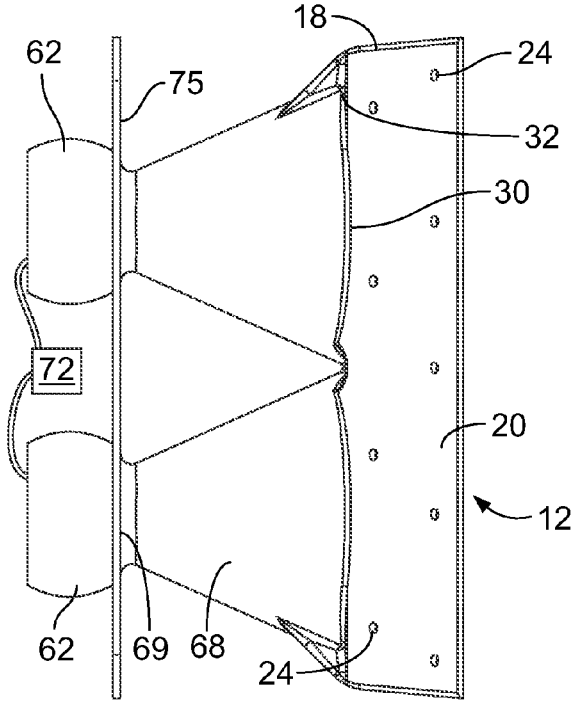
FIG. 14 illustrates in a side view the dual phase plug device as shown in FIG. 12, the device utilizing two inventive phase plugs in the environment of a loudspeaker assembly.

Referring now to FIGS. 12, 13 and 14, wherein details of a dual phase plug device 12 are shown in FIGS. 13 and 14, and the preferred construction of the loudspeakers 90 is shown and described. Horn sections, both vertically extending panels 16 and horizontally extending panels 18, are connected to the phase plug device 12 by means of connecting plates 20 and 22, respectively, providing the side and top/bottom walls, respectively. Both the plates 20, 22 and include a plurality of connection throughholes apertures 24 that are oriented and positioned with corresponding apertures (not visible in FIG. 12) disposed in the horn sections so that an appropriate attachment means (not shown) can be used to attach the plates 20 to the sections 16 and to attach the plates 22 to the sections 18. Upon final assembly of all the loudspeakers 90 together in the array 100 shown in FIG. 13 is completed and ready for use.

As can be seen in the detailed views of FIGS. 12 and 14, wherein one dual phase plug device 12 is shown in a front view and a side view respectively, the inventive phase plug insert 50 is partially visible in FIG. 12 through the front aperture 30 defined by the innermost vertical edges 32 of the plates 20 and of horizontal edges 34 of plates 22. The phase plug insert 50 is shown in FIG. 12 to be supported within the structure of the phase plug housing 12 (FIG. 14) by support surfaces 52, shown in FIG. 13. As can be seen, the edges 32 have a much longer dimension than the edges 34, making the output aperture 30 elongated and essentially rectangular. As the wavefront of the sound reaches the aperture 30, it is desirable for the characteristics of the insert 50 and inner wall 82 of the chamber of the phase plug to define one conduit 83 in which all the discrete sound energy being directed into the aperture 69 at the input end (FIG. 4) reaches the output at aperture 30 with the desired curvature, or no curvature in the case of a planar wavefront. The synchronization of the identical wavefronts from adjacent phase plugs 68 to reach their respective output apertures 30 at the same instant provides a coherent wavefront essentially free of interference.

Referring now more particularly to the side view of FIG. 14, a dual phase plug and compression driver system is shown. The reverse sides of the connecting plates 20 and 22 are shown with the connection apertures 24 extending therethrough. The dual phase plug configuration, having dual drivers 62, as shown in FIG. 14, may be preferred specific applications. It should be understood, however, that the same principles apply to a single phase plug device, having a single driver 62, which may be preferred in other applications.

The compression drivers 62 are each connected to an electrical signal source 66 by appropriate electrical connections, shown in schematic form. For the dual phase plug device 12 to provide a coherent signal, the electrical signal that each compression drivers 62 receives must be synchronized so that the sound energy emanating from the compression drivers 62 into the phase plug devices 68 is identical in the input apertures 69. The phase plug devices 68 transform the circular, planar wavefront directed out of the compression driver apertures into a rectangular planar wavefront emanating from the output aperture 30 shown in FIGS. 1 and 4.

The construction of the phase plug devices 68 may be as those in the prior art, i.e., by constructing two separate shells which are then connected together, for example, by mechanical attachments, glue or other adhesive, similar to that described in the aforementioned Heil patent, U.S. Pat. No. 5,163,167, which disclosure is incorporated herein by reference. If made of a plastic material, the shells can be formed by known plastic molding processes. Support board 75 is provided for mounting of the acoustic compression drivers 62 on the phase plug devices 68 by an appropriate means, such as adhesive or metal fasteners. Of course, apertures 77 in the board 75 are required to enable the acoustic energy output by the compression drivers 62 to enter the phase plug devices 68 through their input apertures 69.

As described above, different shapes and designs to the basic contour of the conduit 83 can be achieved once the parameters of the invention described herein are understood and placed into practice. Any alterations or modifications herein are to be encompassed by the description and claims hereof. For example, while a true conical surface is shown in FIGS. 1 and 4 immediately adjacent the apex 47 of portion 51, an alternative initial conical portion 151 may take other forms, for example, a truncated conical portion such, as is shown in FIG. 16, and the corresponding cross-section FIG. 16A.

Figure 16:
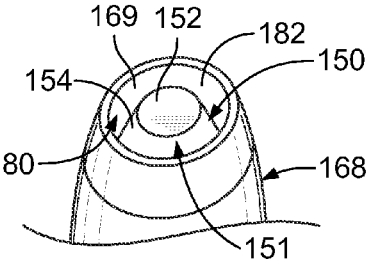
FIG. 16 is a detail view of the input aperture of a phase plug shown in FIG. 15.
Figure 16A:
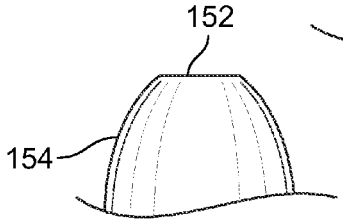
FIG. 16A is a side profile view of the conical end of the phase plug insert partially shown in FIG. 16.
Figure 16B:
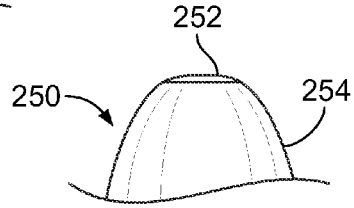
FIG. 16B is a side profile view of an alternative embodiment of a phase plug insert end similar to that shown in FIG. 16A.

The truncated cone 151 need not comprise the form of a flattened end 152 as shown in the isometric view of FIG. 16 or the corresponding profile view of FIG. 16A. One possible modification to the conical section 251 can provide for other shapes, such as a bullet nose 252 shown in profile in FIG. 16B. It must be understood however, that the outer surfaces 154, 254 are contoured to follow the shape of the inner wall 182 of a phase plug 168 having an annular aperture 180 (FIG. 16). Ideally, the end surfaces 152, 252 of the insert 150, 250 do not extend beyond the opening defined by aperture 180. As can be seen, the very end of the conical portion 51 has a flattened part 152. This should not affect the wavefront entering the input aperture 69 as long as the dimensions of the flattened part 152 are small compared to the wavelength of the frequencies for which the phase plug device 68 is designed to work. This ensures that the sound energy reflected off the flat part 152 is negligible relative to the remaining energy of the wavefront that does enter the input aperture 69.

Figure 17:
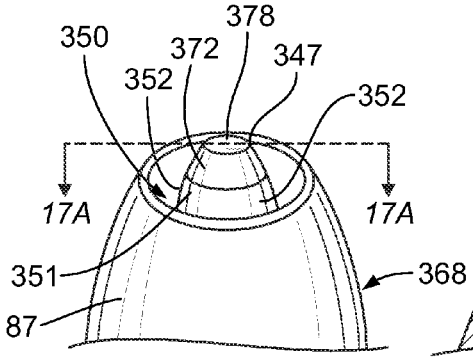
FIG. 17 is an isometric view of an alternate embodiment of a phase plug with the insert end formed to complement the shape of the loudspeaker driver diaphragm/cone with which it is used.
Figure 17A:
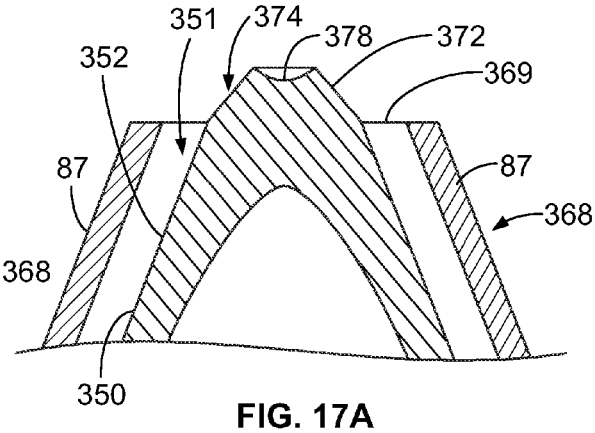
FIG. 17A is a cross-sectional side view of the alternate embodiment of the phase plug shown in FIG. 17 taken approximately along the plane 17A-17A.

Referring now to FIGS. 17 and 17A, still another embodiment of the input aperture end 347 of the insert 350 is shown. FIG. 17A is a cross section of the shell wall 87 and insert 350 shown in FIG. 17, taken approximately along the line 17A-17A. This embodiment of insert 350 is particularly suited for a cone-type loudspeaker, rather than for a compression driver. It comprises essentially an identical shell wall 87, but the essentially conical end portion 351 of the insert 350 does not converge to a point (as does the insert 50 in FIGS. 4, 4A, 4B), nor to a truncated cone (as in FIGS. 16A-C), but includes features that make it suitable to its specific use. As shown, the essentially conical end 351 terminates at a protruding structure 374 which has the general shape of a volcano caldera. That is, protruding axially out of the end of the wall 87 at the input aperture 369 is the conical section 374 having a generally conical wall 372 that terminates proximate to the same plane as the end of wall 82 defining the input aperture 369. Instead of terminating in a point, as in FIGS. 4 and 4A, or in a convex surface, as in FIG. 16B, the end point of the protruding structure 374 is a concave surface 378. The remainder of the conical portion 351, indeed the remainder of the insert 350, has essentially the same shape, including outer surface 352 of the insert 350, as do the other embodiments described above. Within the termination of the slanted walls 372 is a concave caldera 378 that provides appropriate input characteristics for the sound energy that would emanate into this phase plug embodiment 368 from a cone-type loudspeaker (not shown).

A benefit of an alternate embodiment of the present invention (not shown in the drawings) is that a device can also be designed to yield a rectangularly shaped wavefront at the exit aperture 30 that is not perfectly planar with respect to the vertical dimension of the device. The exact amount of wavefront curvature, along the height of a device designed in accordance with the present invention, can be specified and the device can be designed to yield a desired amount of curvature in the wavefront.

For this to occur, the path lengths of the sound wave propagating through a device must not all be equal. If a convex wave front is desired, the path lengths along angles less than $\phi_{max}$ must be shorter than the path length of $r_{max}$. Conversely, if a concave wavefront is desired, the path lengths along angles less than $\phi_{max}$ must be longer than the path length of $r_{max}$.

Referring now to FIG. 18, a schematic side view illustrates the required path length difference to provide for the desired curvature in the output wavefront by intentionally designing variation in the path length as a function of the angle $\phi$. First, the angle of desired curvature of the wavefront, $\alpha$, at the exit aperture 30 of the device is specified by the design engineer. Based on the height of the inner core, $H_{core}$, for the device and the angular curvature, $\alpha$, a radius of curvature, $R_{WF}$, for the wave front may be calculated in accordance with equation (m) below.

$$R_{WF} = \frac{H_{core/2}}{\sin(\alpha/2)} \tag{m}$$

At each angular increment $0° \leq \phi < \phi_{max}$ the height of the inner core, $j_i$, at the exit of the device should be calculated. Alternatively, incremental heights, $j_i$, between 0 and $H_{core}$ may be specified and the incremental angle, $\phi$, calculated. Regardless of which is chosen, the following equations are used to calculate the required change, $k_i$, to the path length, $F_i$, that would otherwise be equal to $r_{max}$ in order to yield the desired wave front curvature.

$$m=\sqrt{R_{WF}^2+(H_{core}/2)^2} \tag{n}$$

$$g_i=\sqrt{m^2+j_i^2} \tag{o}$$

$$k_i=R_{WF}-g_i \tag{p}$$

$$F_i=r_{max}-k_i \tag{q}$$

The value of $k_i$ in equation (p) is used to modify the original target path length of $r_{max}$. The new target path length is given by equation (q). By using these target path lengths at each angular increment $\phi$ (or height increment $j_i$), the inventive device can provide a desired amount of curvature in the wavefront 85C (FIG. 18), whether a concave curvature or a convex curvature.

Once a series of adjoining paths are determined for several discrete angles $\phi$, a rough contour form can be generated for the insert 50, and can be considered to be a wire frame outline of the final device, each of the "wires" being a contour of a "slice" of a the surface 52 as calculated by the equations above. It is necessary to smooth out the spaces between the "slices" taken at the discrete angles. If the discrete angles $\phi$ are taken at increasingly smaller intervals between adjoining one of the angles $\phi$, the process can achieve a very close approximation to the smooth contour shape of the final contour of phase plug insert 50. Individual discrete angles $\phi$ may be chosen in such a manner that the difference in the discrete incremental heights ($H_1-H_0$, $H_2-H_1$, $H_3-H_2$, . . . ) at the exit aperture 30 are small compared to the wavelength of the highest frequency for which a phase plug device 68 is designed to be used.

The waveguide conduit 83 is defined by the surfaces 52 and 82. The inner surface 82 is disposed on the inner facing wall of the outer shell 87 and is generated to provide a smooth conduit path for the wave energy to propagate therethrough without any discontinuities. The outer surface 52 of the insert 50 is described above, including the mathematical equations and process to obtain the contour surface of the insert 50. Once the surface 52 has been created by the preceding description and adequately defines the contour of insert 50, it becomes possible to define the contours of internal chamber wall surface 82 of the outer shell 87. The relationship of surfaces 52 and 82 are briefly described above as being equidistant throughout the conduit 83 when the measurement is taken perpendicularly relative to the surfaces 52, 82. This definition requires its own set of equations, based on the ones used to define the contour of the outer surface 52, as is described below relative to the Offset O. Of course, the same smoothing function that occurs for the surface 52 of the insert 50 should also be followed in the generation of the internal chamber wall surface 82 of the outer shell 87.

Taking as given the above values, such as a and b for one of the defining ellipses within a given angular cross section of insert 50, and other relevant parameters, set forth above, reference to FIGS. 1, 4 and 5, taken together, show the relationship between the two surfaces 52, 82. The ellipse for the surface 82 is shown in cross-section in FIGS. 1 and 4, is also defined by offsetting the ellipse used for the insert 50. The offset distance O is simply added to the semi-major and semi-minor axes a and b when the contour lines of surface 52 are otherwise defined along the middle portion 53.

It should be noted that the normal direction, that is the direction normal to the propagation of sound energy at any point along the conduit 83, while constant as measured within a given angular cross section, will obtain different values for other angular cross sections. However, the value will remain constant within a given angular cross section.

The offset distance O can be more conveniently quantified by the distance perpendicular to the surface 52 of the insert 50. This is a function of the angle $\theta_{Tangent\ Line}$ and is given by the equation below. To make the equations a bit simpler we will use beta, β, to represent $\theta_{Tangent\ Line}$:

$$\beta = \theta_{Tangent\ Line}$$

$$\text{Offset } O = \frac{d}{2} * \cos\beta$$

The ellipse for the inner surface 82 in the cross section is also defined by offsetting the ellipse used for the insert 50. The offset distance is simply added to the semi-major and semi-minor axes values, a and b, of the ellipse (elliptical portion 53) of insert 50.

$$a_{surface\ 82} = a_{insert\ surface\ 52} + \text{Offset } O$$

$$b_{surface\ 82} = b_{insert\ surface\ 52} + \text{Offset } O$$

Two additional considerations that must be addressed in defining the surface 82. The first is that as the cross sections are taken at progressively greater angles ϕ through the insert 50 (FIGS. 1-5), an unmodified offset at the entry of the phase plug 68 would result in a rectangular or square opening (not shown), not a circular opening 69, as desired, to mate with a compression driver or other generally circular loudspeaker driver 62, shown in FIG. 4A.

The starting point of the tangent line, t, which defines the outer surface 82, must be "tilted" a bit so that it will lie on the circular perimeter of the entry aperture 69 relative to the phase plug. To calculate the rotational angle around the circular entry aperture 69 where a given tangent line, t, will intersect the circular entry, the following equations are used.

$$\text{Throat Angle} = \text{Throat Ratio} * 90°$$

where $$\text{Throat Ratio} = \phi_n / \phi_{max} \text{ and}$$

$\phi_n$ is the angular increment set for a particular cross section taken at the specified angle, as described above.

In this manner, regardless of how many different angular cross sections are taken at different cross-section angles ϕ to define the surface 52 of the insert 50, the offset O of each one is set proportionally at the proper place on the circular perimeter of the entry.

The second consideration is the point on an ellipse which defines the outer shell surface 82 at which the tangent line t intersects it, the ellipse, and is tangent to it. The x and y coordinates of this point, in the plane of the angular cross section, are given by the following equations.

$$x_{pp} = p + O * \cos\beta$$

$$y_{p\phi} = p/e - O * \sin\beta$$

where $x_{p\phi}$ is the lateral dimension within the plane of the angular cross section, and $y_{p\phi}$ is the axial dimension within the plane of the angular cross section.

The z coordinate would correspond to the height dimension.

The invention herein has been described and illustrated with reference to the embodiments of FIGS. 1-18, but it should be understood that the features and operation of the invention as described are susceptible to modification or alteration without departing significantly from the spirit of the invention. For example, the dimensions, size and shape of the various elements may be altered to fit specific applications, or specific dimensions of the loudspeaker systems. Accordingly, the specific embodiments illustrated and described herein are for illustrative purposes only and the invention is not limited except by the following claims.

What is claimed is:

1. A sound energy waveguide, comprising:

(a) a unitary chamber having a substantially circular input aperture at one end of said chamber and an elongated, thin output aperture at an opposed end of said chamber, said chamber comprising an outer wall having an inner surface;

(b) an integral insert disposed within said unitary chamber, said insert having a continuous, smooth, outer surface and a positioning mount for disposing the insert within the inner surface of the outer wall of the unitary chamber, said insert further comprising:

i) a first essentially conical portion located adjacent the input aperture when disposed within the unitary chamber, ii) a third wedge shaped portion having an elongated end proximate the elongated output aperture when disposed within the unitary chamber, and iii) an ovoid central section disposed between said first and second portions, wherein the outer surfaces of the three portions are without discontinuities and blend one into the other to provide a smooth outer surface of the insert; and wherein the inner surface of the chamber wall and the insert outer surface are equidistantly disposed from each other throughout the unitary chamber when measured perpendicularly to the respective surfaces, the two wall surfaces defining an acoustic conduit between the inner surface of the outer chamber wall and the outer surface of the insert, the equidistant relationship between the surfaces in said conduit completely extending from the input aperture to the output aperture of said unitary chamber, said conduit thereby forming a waveguide that provides essentially constant length paths that extend from said input aperture to said output aperture of said unitary chamber, the waveguide propagating sound waves along said substantially constant length paths from said input aperture to said output aperture of said unitary chamber.

2. The sound energy waveguide according to claim 1 wherein the conduit defined within said unitary chamber forming the waveguide provides for essentially constant length paths that extend from said input aperture to said output aperture for any specified angle of traversal through the waveguide, the shape of the ovoid central section being defined within specified parameters by a predetermined relationship calculated to provide the constant length paths across all specified angles.

3. The sound energy waveguide according to claim 2 wherein the conduit constant path lengths F from the input to the output apertures in said unitary chamber are defined by the following equations for each cross-section taken essentially at a specified discrete angle ϕ, relative to the plane containing the centerline of the waveguide, through the insert:

$$F = 2*(t+S) \text{ and} \quad \text{(a)}$$

$$t = \sqrt{p^2 + (p/e)^2} \quad \text{(b)}$$

where

F is the path length from the input to the output apertures through the sound energy waveguide S is a close approximation of the arc length for the section of the ellipse between the intersection of the semi-latus rectum, p, and the semi-minor axis, b, taken at a discrete angle $\phi$, and t is the straight line segment between the tangent point to the ellipse and the directrix of the ellipse, contained in the plane of either the input aperture or the output aperture; and e is the eccentricity of the ellipse as defined by the semi-minor axis b and semi-major axis a, and wherein the angle from the semi-major axis, a, to the straight line segment, t, is given by $$\theta_{Tangent\ Line}=\tan^{-1}\left(\frac{p}{p/e}\right)=\tan^{-1}(e) \quad (c)$$

S being defined by the equation $$S=a*(\sin\theta_{circle}+(\theta_{circle}-\sin\theta_{circle}))*(b/a)^{(2-0.216*\theta_{circle}^2)} \quad (d)$$

where b and a are the semi-minor axis and semi-major axis, respectively, to be solved for each discrete angle $\phi$ to yield the desired path length F, $\theta_{circle}$ is the angle from the semi-major axis, b, to the line connecting the center of the ellipse at the specified discrete angle $\phi$ with the point on a circle circumscribing the ellipse at which the projection of the semi-latus rectum, p, intersects the circumscribed circle, and where the above values of a, b, and $\theta_{circle}$ for each discrete angle $\phi$ are defined by the initial dimensional parameters of the desired waveguide where L is length of the waveguide device as measured from the input aperture to the output aperture;

$H_{core}$ is the height of the insert at the elongated, thin output aperture end of said waveguide chamber;

and the values of F are equal to those of $r_{max}$;

$r_{max}$ is defined by the equation $$r_{max}=\frac{L}{\cos\varphi_{max}} \quad (e)$$

where $\phi_{max}$ is defined by the discrete angle $\phi$ that is the most extreme angle that provides a straight line path extending from the center of the circular input aperture to one longitudinal end of the insert at the output aperture, and is given by the equation $$\varphi_{max}=\tan^{-1}\frac{H_{core}/2}{L}; \quad (f)$$

and wherein the distance between the two directrices of the ellipse for each discrete angle is equal to the length of the waveguide, $L_\phi$, in the plane of said discrete angle written mathematically as $$2(c+p/e)=L_\theta;\ \text{and} \quad (g)$$

$$c=a*e \quad (h)$$

allowing the value of the semi-minor axis, b, to be solved as a function of the length of the waveguide, L, and the semi-major axis of the ellipse, a, according to the equation:

$$b=\sqrt{a^2-4a^2/L_\theta^2}. \quad (i)$$

4. The sound energy waveguide according to claim 2 wherein the longest path length $r_{max}$ is the same length as any other path through the conduit of the shortest possible path length, as defined from the input aperture to an end of the output aperture disposed at a vertical end thereof.

5. A method of determining the shape and physical dimensions for an acoustic conduit of a sound energy waveguide, the waveguide having a circular input aperture and an elongated, thin output aperture, the acoustic conduit shape and orientation being defined by an insert to be disposed within a chamber, comprising:

(a) establishing design parameters for the sound energy waveguide, including a longitudinal dimension of the insert as measured at the output aperture end adjacent $H_{core}$, the length L from as measured directly from the center of the circular input aperture to the center of the longitudinal end of the elongated, thin output aperture, to derive an angle $\phi_{max}$ defined by the maximum angle from the line L at the circular input aperture to the end of the output aperture adjacent $H_{core}$, (b) determining a path length $r_{max}$ measured as a straight line path from the circular input aperture to the elongated, thin output aperture along the angle $\phi_{max}$, (c) setting all the path lengths F traversing over the surface of the insert measured at incremental discrete cross section angles $\phi$ through the acoustic conduit from the circular input aperture to the elongated, thin output aperture to be equal to $r_{max}$, (d) utilizing appropriate equations, and using said design parameters including $r_{max}$, to set values for the path lengths F defining equal path lengths from the circular input aperture to elongated, thin output aperture, thereby obtaining partial path lengths S being measured at the specified discrete cross section angles $\phi$, where for each angle $\phi$, the values of a semi-minor axis b and a semi-major axis a parameters of a central elliptical section of the insert are obtained, (e) calculating the value of F and using the values of a semi-minor axis b and a semi-major axis a parameters of each central elliptical section of the insert derived from step (d) and comparing it to the value of $r_{max}$, (f) using the difference in the compared value of F and $r_{max}$ to perform a reiterative calculation of the values of a and b until the difference between F and $r_{max}$ is negligible, (g) once the values of a and b for the specified cross section angle $\phi$ are obtained, determining other parameters of the path lengths F, including straight line path segments t, for a first conical portion extending from the central aperture to the ovoid central section and for a third wedge shaped portion defining a line extending tangent from the ovoid central portion to the elongated, thin output aperture, the line path segments t being disposed at either end of the insert on opposite sides of the central ovoid portion, using appropriate algorithms, (h) repeating the steps (c) through (g) for each specified cross section angle $\phi$, and repeating for a sufficient number of discrete cross section angles $\phi$, thereby to enable establishing the dimensions of the shapes of the central ovoid portion, the first conical portion and the third wedge shaped portion, (i) smoothing the shape of the insert between adjacent discrete cross section angles $\phi$, thereby defining the shape of the insert for a cross-section thereof taken at that specified angle $\phi$, for the insert; and (j) deriving a corresponding defined shape of an inner surface of the chamber through use of appropriate algorithms thereby to define the acoustic conduit.

6. The method of determining the shape and physical dimensions for an acoustic conduit of a sound energy waveguide according to claim 5, wherein the algorithms utilized for each line path F for each cross-section taken essentially at a specified discrete angle $\phi$, relative to the plane containing the centerline of the waveguide, through the insert, are as follows:

$$F=2/(t+S) \text{ and} \tag{a}$$

$$t=\sqrt{p^2+(p/e)^2} \tag{b}$$

where

F is the path length from the input to the output apertures through the sound energy waveguide S is a close approximation of the arc length for the section of the ellipse between the intersection of the semi-latus rectum, p, and the semi-minor axis, b, taken at a discrete angle $\phi$, and t is the straight line segment between the tangent point to the ellipse and the directrix of the ellipse, contained in the plane of either the input aperture or the output aperture; and e is the eccentricity of the ellipse as defined by the semi-minor axis b and semi-major axis a, and wherein the angle from the semi-manor axis, a, to the straight line segment, t, is given by $$\theta_{Tangent\ Line}=\tan^{-1}\left(\frac{p}{p/e}\right)=\tan^{-1}(e) \tag{c}$$

S being defined by the equation (d)

$$S=a*(\sin\theta_{circle}+(\theta_{circle}-\sin\theta_{circle}))*(b/a)^{(2-0.216*\theta_{circle})} \tag{d}$$

where b and a are the semi-minor axis and semi-major axis, respectively, to be solved for each discrete angle $\phi$ to yield the desired path length F (to be equalized to $r_{max}$), $\theta_{circle}$ is the angle from the semi-major axis, b, to the line connecting the center of the ellipse at the specified discrete angle $\phi$ with the point on a circle circumscribing the ellipse at which the projection of the semi-latus rectum, p, intersects the circumscribed circle, and where the above values of a, b, and $\theta_{circle}$ for each discrete angle $\phi$ are defined by the initial dimensional parameters of the desired waveguide where L is length of the waveguide device as measured from the input aperture to the output aperture;

$H_{core}$ is the height of the insert at the elongated, thin output aperture end of said waveguide chamber;

and the values of F are equal to those of $r_{max}$;

$r_{max}$ is defined by the equation $$r_{max}=\frac{L}{\cos\varphi_{max}} \tag{e}$$

where $\phi_{max}$ is defined by the discrete angle $\phi$ that is the most extreme angle that provides a straight line path extending from the center of the circular input aperture to one longitudinal end of the insert at the output aperture, and is given by the equation $$\varphi_{max}=\tan^{-1}\frac{H_{core}/2}{L}; \tag{f}$$

and wherein the distance between the two directrices of the ellipse for each discrete angle $\phi$ is equal to the length of the waveguide, $L_\phi$, in the plane of said discrete angle written mathematically as $$2(c+p/e)=L_\phi; \text{ and} \tag{g}$$

$$c=a*e \tag{h}$$

and by allowing the value of the semi-minor axis, b, to be solved as a function of the length of the waveguide, L, and the semi-major axis of the ellipse, a, according to the equation:

$$b=\sqrt{a^2-4a^2/L_\phi^2} \tag{i}$$

determining the value of b for the specified cross section angle $\phi$.

7. The method of determining the shape and physical dimensions for an acoustic conduit of a sound energy waveguide according to claim 6 wherein reiterative calculation of the values of a and b are used to calculate the value of F further comprises:

(i) utilizing estimated value of a to provide a value of F;

(ii) comparing the difference in the value of F derived by inserting the estimated value of a with the determined path length $r_{max}$;

(ii) determining a new estimated value of a that provides a closer compared difference between the value of F and $r_{max}$;

(iii) reiterating steps (ii) and (iii) above until the difference between the calculated values of F and $r_{max}$ produce a negligible difference; and (iv) utilizing the value of a that produces the value of F in the last iteration in establishing the physical parameters of the ovoid central section of the insert for the specified cross section angle $\phi$.

8. The method of determining the shape and physical dimensions for an acoustic conduit of a sound energy waveguide according to claim 7 wherein for the insert ellipse calculated at each discrete angle $\phi$, the required offset O is added to the values of a and b, thereby providing an offset ellipse, whereby the offset ellipse yields values for the elliptical inner surface of the outer shell wall defining a facing surface of the conduit facing the outer surface of the insert ellipse.

9. The method of determining the shape and physical dimensions for an acoustic conduit of a sound energy waveguide according to claim 8 wherein the offset dimension O is quantified by the distance perpendicular to the surface of the insert and by the angle $\theta_{Tangent\ Line}$, $\theta_{Tangent\ Line}$ being identical to $\beta$, at which the straight line segment between the tangent point to the ellipse and the directrix of the ellipse t is given by the equation below $$O = \frac{d}{2} * \cos\beta \quad \text{(i)}$$

where d is the diameter of the input aperture.

10. The method of determining the shape and physical dimensions for an acoustic conduit of a sound energy waveguide according to claim 8, wherein the elliptical sections of the elliptical inner surface of the outer shell wall are defined by the following equations:

$$a_{surface\ 82} = a_{insert\ surface\ 52} + \text{Offset } O \quad \text{(j)}$$

$$b_{surface\ 82} = b_{insert\ surface\ 52} + \text{Offset } O \quad \text{(k).}$$

11. The method of determining the shape and physical dimensions for an acoustic conduit of a sound energy waveguide according to claim 8 wherein the starting point for the tangent line to the surface of the insert at the ovoid central section, $t_{surface\ 82}$, is determined by rotating around the perimeter of the circular input aperture, and the rotation angle is determined by dividing equally by the total number of increments for each discrete angle ϕ given using the following equations:

$$\text{Throat Angle} = \text{Throat Ratio} * 90°$$

where $$\text{Throat Ratio} = \phi_n / \phi_{max}.$$

12. The method of determining the shape and physical dimensions for an acoustic conduit of a sound energy waveguide according to claim 8 further comprising:

interpolating the geometry of the outer wall between adjacent increments of the discrete angles ϕ calculated using the equations, and thereby smoothing out the surface of the outer wall between the ovoid shapes calculated for each angle ϕ to define further the shape of the outer wall of the insert.

* * * * *